US011234542B2

(12) United States Patent
Bolek et al.

(10) Patent No.: US 11,234,542 B2
(45) **Date of Patent: *Feb. 1, 2022**

(54) DRINK CUP LID

(71) Applicant: Berry Plastics Corporation, Evansville, IN (US)

(72) Inventors: Chris Bolek, Evansville, IN (US); Jonathan Eickhoff, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 91 days.

This patent is subject to a terminal disclaimer.

(21) Appl. No.: 15/172,650

(22) Filed: Jun. 3, 2016

(65) Prior Publication Data

US 2016/0278554 A1 Sep. 29, 2016

Related U.S. Application Data

(63) Continuation of application No. 14/209,984, filed on Mar. 13, 2014, now Pat. No. 9,364,107.

(60) Provisional application No. 61/801,433, filed on Mar. 15, 2013.

(51) Int. Cl.

| | |
|---|---|
| ***A47G 19/22*** | (2006.01) |
| ***B65D 43/02*** | (2006.01) |
| ***B65D 47/10*** | (2006.01) |

(52) U.S. Cl.

CPC ..... *A47G 19/2272* (2013.01); *A47G 19/2205* (2013.01); *B65D 43/0212* (2013.01); *B65D 47/10* (2013.01); *B65D 2543/00046* (2013.01); *B65D 2543/00092* (2013.01); *B65D 2543/00222* (2013.01); *B65D 2543/00296* (2013.01); *B65D 2543/00509* (2013.01); *B65D 2543/00537* (2013.01); *B65D 2543/00555* (2013.01); *B65D 2543/00638* (2013.01); *B65D 2543/00685* (2013.01); *B65D 2543/00731* (2013.01); *B65D 2543/00796* (2013.01)

(58) Field of Classification Search

CPC ..... A47G 19/2205; B65D 1/265; B65D 43/0212; B31F 1/0087

See application file for complete search history.

(56) References Cited

U.S. PATENT DOCUMENTS

| | | | |
|---|---|---|---|
| D7,248 | S | 3/1874 | elstrand |
| D53,911 | S | 10/1919 | Humphrey |
| D58,571 | S | 8/1921 | Hyatt |
| 1,395,594 | A | 11/1921 | Pfefferle |

(Continued)

FOREIGN PATENT DOCUMENTS

| | | |
|---|---|---|
| CN | 3107990 | 1/1999 |
| CN | 99813627 | 1/1999 |

(Continued)

OTHER PUBLICATIONS

Office Action dated Oct. 6, 2017 for U.S. Appl. No. 15/485,299; (pp. 1-5).

(Continued)

*Primary Examiner* — Andrew D Perreault

(74) *Attorney, Agent, or Firm* — Barnes & Thornburg LLP

(57) ABSTRACT

A liquid container includes a cup having a brim forming an opening into an interior region of the cup. The container also includes a lid configured to mount on the brim of the cup to close the opening.

13 Claims, 13 Drawing Sheets

(56) References Cited

U.S. PATENT DOCUMENTS

| | | | |
|---|---|---|---|
| D62,268 | S | 4/1923 | Stern |
| D64,091 | S | 2/1924 | Weintraub |
| D65,193 | S | 7/1924 | Leveridge |
| D78,805 | S | 6/1929 | Burke |
| 1,755,042 | A | 4/1930 | Zoller |
| 1,773,972 | A | 8/1930 | Eberhart |
| 1,940,088 | A | 12/1933 | Harrison |
| 2,015,028 | A | 9/1935 | Gillette |
| 2,050,487 | A | 8/1936 | Durrant |
| 2,120,403 | A | 6/1938 | Godfrey |
| D111,097 | S | 8/1938 | White |
| 2,174,618 | A | 10/1939 | Burdick |
| 2,271,589 | A | 2/1942 | Hendrickson |
| 2,313,801 | A | 3/1943 | Carll |
| 2,374,092 | A | 4/1945 | Glaser |
| D141,225 | S | 5/1945 | Ray |
| 2,447,407 | A | 8/1948 | Grain |
| 2,649,984 | A | 8/1953 | Abt |
| D172,089 | S | 5/1954 | Du Pree |
| 2,766,796 | A | 10/1956 | Tupper |
| 2,985,354 | A | 5/1961 | Aldington |
| 3,027,596 | A | 4/1962 | Knowles |
| 3,048,317 | A | 8/1962 | Cochrane |
| 3,055,540 | A | 9/1962 | Ringlen |
| 3,065,875 | A | 11/1962 | Negoro |
| 3,071,281 | A | 1/1963 | Sawai |
| 3,103,224 | A | 9/1963 | Dearling |
| 3,128,903 | A | 4/1964 | Crisci |
| 3,245,691 | A | 4/1966 | Gorman |
| 3,262,602 | A | 7/1966 | McConnell |
| 3,269,734 | A | 8/1966 | Ottofy |
| 3,301,459 | A | 1/1967 | Gardner |
| 3,329,304 | A | 7/1967 | Crisci |
| 3,329,305 | A | 7/1967 | Crisci |
| 3,349,950 | A | 10/1967 | Wanderer |
| 3,392,468 | A | 7/1968 | Wolf |
| 3,421,653 | A | 1/1969 | Whaley |
| 3,433,378 | A | 3/1969 | Ross |
| 3,524,566 | A | 8/1970 | Parks |
| 3,561,668 | A | 2/1971 | Bergstrom |
| 3,583,596 | A | 6/1971 | Brewer |
| D221,420 | S | 8/1971 | Davis |
| 3,604,588 | A | 9/1971 | Winnick |
| 3,609,263 | A | 9/1971 | Clementi |
| 3,610,306 | A | 10/1971 | Summers |
| 3,612,342 | A | 10/1971 | Rath bun |
| 3,624,787 | A | 11/1971 | Newman |
| D222,905 | S | 2/1972 | Kinney |
| 3,676,089 | A | 7/1972 | Swett |
| 3,677,435 | A | 7/1972 | Davis |
| 3,679,088 | A | 7/1972 | Swett |
| 3,679,089 | A | 7/1972 | Swett |
| D226,063 | S | 1/1973 | Warnberg |
| 3,734,276 | A | 5/1973 | Bank |
| 3,743,133 | A | 7/1973 | Rathbun |
| 3,745,055 | A | 7/1973 | Gorman |
| 3,746,158 | A | 7/1973 | Connick |
| 3,752,042 | A | 8/1973 | Castille |
| 3,768,688 | A | 10/1973 | Linke |
| 3,805,991 | A | 4/1974 | Cheladze |
| 3,817,420 | A | 6/1974 | Heisler |
| 3,828,637 | A | 8/1974 | Slack |
| 3,840,144 | A | 10/1974 | Dry |
| D233,599 | S | 11/1974 | Davis |
| 3,926,084 | A | 12/1975 | Blazer |
| RE28,797 | E | 5/1976 | Brewer |
| 3,977,563 | A | 8/1976 | Holt |
| D242,736 | S | 12/1976 | Craft |
| D242,738 | S | 12/1976 | Michaeli |
| 4,006,839 | A | 2/1977 | Thiel |
| 4,007,936 | A | 2/1977 | Hornsby |
| 4,018,355 | A | 4/1977 | Ando |
| 4,026,459 | A | 5/1977 | Blanchard |
| 4,054,229 | A | 10/1977 | Arfert |
| 4,061,706 | A | 12/1977 | Duffield |
| 4,074,827 | A | 2/1978 | Labe |
| 4,078,686 | A | 3/1978 | Karesh |
| 4,190,174 | A | 2/1980 | Haimowitz |
| 4,194,645 | A | 3/1980 | Zabner |
| 4,210,258 | A | 7/1980 | von Holdt |
| D256,558 | S | 8/1980 | Smith |
| D258,576 | S | 3/1981 | Smith |
| 4,266,689 | A | 5/1981 | Asher |
| 4,293,080 | A | 10/1981 | Letica |
| D262,691 | S | 1/1982 | Horsley |
| D264,440 | S | 5/1982 | Austin |
| D264,690 | S | 6/1982 | Bagwell |
| 4,349,119 | A | 9/1982 | Letica |
| 4,351,448 | A | 9/1982 | Ingersoll |
| 4,370,908 | A | 2/1983 | Dealto |
| 4,380,305 | A | 4/1983 | Von Holdt |
| 4,389,802 | A | 6/1983 | McLaren |
| 4,408,698 | A | 10/1983 | Ballester |
| 4,412,467 | A | 11/1983 | Desanto |
| 4,413,964 | A | 11/1983 | Winstead |
| 4,421,244 | A | 12/1983 | Van Melle |
| 4,444,332 | A | 4/1984 | Widen |
| 4,446,986 | A | 5/1984 | Bowen |
| 4,474,305 | A | 10/1984 | Marco |
| 4,508,235 | A | 4/1985 | Steele |
| 4,518,097 | A | 5/1985 | Milton |
| 4,524,882 | A | 6/1985 | Buc |
| 4,562,937 | A | 1/1986 | Iyengar |
| D286,026 | S | 10/1986 | Rayner |
| 4,629,088 | A | 12/1986 | Durgin |
| 4,640,434 | A | 2/1987 | Johnsen |
| 4,640,435 | A | 2/1987 | Dutt |
| 4,674,644 | A | 6/1987 | Jacobs |
| 4,679,699 | A | 7/1987 | Malsbury |
| D292,380 | S | 10/1987 | Smith |
| 4,721,210 | A | 1/1988 | Lawrence |
| 4,722,820 | A | 2/1988 | Flecknoe-Brown |
| 4,782,976 | A | 11/1988 | Kenyon |
| D298,919 | S | 12/1988 | Gee |
| 4,799,602 | A | 1/1989 | Collins |
| 4,836,407 | A | 6/1989 | Bruce |
| 4,872,586 | A | 10/1989 | Landis |
| 4,886,184 | A | 12/1989 | Chamourian |
| 4,934,557 | A | 6/1990 | Smith |
| D309,564 | S | 7/1990 | Rayner |
| 4,971,211 | A | 11/1990 | Lake |
| 4,994,229 | A | 2/1991 | Flecknoe-Brown |
| D317,262 | S | 6/1991 | Bluff |
| 5,064,082 | A | 11/1991 | Lombardi |
| 5,088,367 | A | 2/1992 | Cracchiolo |
| 5,099,232 | A | 3/1992 | Howes |
| 5,106,567 | A | 4/1992 | Demerest |
| 5,111,961 | A | 5/1992 | Van Melle |
| 5,151,233 | A | 9/1992 | Wendt |
| 5,180,079 | A | 1/1993 | Jeng |
| D339,027 | S | 9/1993 | Mack |
| 5,375,828 | A | 12/1994 | Shikami |
| 5,377,860 | A | 1/1995 | Littlejohn |
| 5,390,810 | A | 2/1995 | Stroble |
| 5,397,023 | A | 3/1995 | Toczek |
| 5,398,843 | A | 3/1995 | Warden |
| 5,427,266 | A | 6/1995 | Yun |
| 5,460,286 | A | 10/1995 | Rush |
| D365,516 | S | 12/1995 | Williamson |
| 5,489,026 | A | 2/1996 | DAloia |
| D368,430 | S | 4/1996 | Herzog |
| D368,444 | S | 4/1996 | Shryock |
| 5,509,568 | A | 4/1996 | Warden |
| 5,524,788 | A | 6/1996 | Plester |
| 5,531,347 | A | 7/1996 | Goulding |
| 5,542,532 | A | 8/1996 | Mitchell |
| D374,822 | S | 10/1996 | Philips |
| 5,592,766 | A | 1/1997 | Mygatt |
| 5,613,619 | A | 3/1997 | Van Melle |
| 5,614,228 | A | 3/1997 | Demerest |
| 5,641,063 | A | 6/1997 | Gambardella |
| D380,385 | S | 7/1997 | Litke |
| D381,267 | S | 7/1997 | Rush |
| D384,580 | S | 10/1997 | Fernandes |

(56) References Cited

U.S. PATENT DOCUMENTS

D384,862 S 10/1997 Hayes
5,713,463 A 2/1998 Lakoski
5,722,558 A 3/1998 Thompson
5,746,312 A 5/1998 Johnson
5,769,263 A 6/1998 Willingham
5,775,194 A 7/1998 Spada
5,783,229 A 7/1998 Manlove
5,791,509 A 8/1998 Rush
5,795,535 A 8/1998 Giovannone
5,806,707 A 9/1998 Boehm
5,820,016 A 10/1998 Stropkay
5,829,583 A 11/1998 VerWeyst
5,839,601 A 11/1998 Melle
5,868,309 A * 2/1999 Sandstrom ..... B31F 1/0038 162/180
D408,223 S 4/1999 Henry
5,894,952 A 4/1999 Mendenhall
5,913,964 A 6/1999 Melton
5,947,323 A 9/1999 Freek
5,979,690 A 11/1999 Hartley
5,983,693 A 11/1999 Bodnar
6,021,917 A 2/2000 Lovell
6,056,144 A 5/2000 Strange
6,070,752 A 6/2000 Nava
D428,355 S 7/2000 Kavalek
D432,868 S 10/2000 Tan
D437,223 S 2/2001 Coy
D437,671 S 2/2001 Fajerstein
6,196,404 B1 3/2001 Chen
6,196,411 B1 3/2001 Nava
6,216,857 B1 4/2001 Gordon
6,257,435 B1 7/2001 Chedister
6,257,629 B1 7/2001 Weichelt
D446,150 S 8/2001 Bamminger
6,299,014 B1 10/2001 Nava
6,302,288 B1 10/2001 Nava
6,311,860 B1 11/2001 Reidinger
D452,155 S 12/2001 Stodd
6,330,943 B1 12/2001 Gordon
6,349,821 B1 2/2002 Gordon
6,357,619 B1 3/2002 Schaefer
6,364,102 B1 4/2002 Gordon
6,371,289 B1 4/2002 Gordon
6,404,730 B2 6/2002 Yeo
6,412,629 B1 7/2002 Gordon
6,419,112 B1 7/2002 Bruce
D461,141 S 8/2002 Steiner
6,454,087 B2 9/2002 Gordon
6,460,716 B1 10/2002 Wong
6,464,072 B2 10/2002 Gordon
6,478,148 B2 11/2002 Gordon
6,481,573 B2 11/2002 Gordon
D468,494 S 1/2003 Holloway
D469,693 S 2/2003 Weiss
D471,810 S 3/2003 Hayes
6,533,114 B1 3/2003 Gordon
6,557,698 B2 5/2003 Gordon
6,561,122 B1 5/2003 Kurja
6,561,345 B2 5/2003 Gordon
6,571,943 B2 6/2003 Gordon
6,588,182 B2 7/2003 Gordon
6,598,741 B2 7/2003 Gordon
6,604,629 B2 8/2003 Gordon
6,612,456 B1 9/2003 Hundley
6,625,959 B2 9/2003 Gordon
6,626,288 B2 9/2003 Gordon
6,647,696 B2 11/2003 Gordon
6,648,134 B2 11/2003 Gordon
D482,985 S 12/2003 Bombeke
6,688,487 B2 2/2004 Oakes
D492,901 S 7/2004 Woods
6,840,375 B2 1/2005 Gordon
D502,050 S 2/2005 Munson
6,874,649 B2 4/2005 Clarke
6,886,707 B2 5/2005 Giraud
6,889,860 B2 5/2005 Mazzarolo
6,910,599 B2 6/2005 Tucker
6,929,143 B2 8/2005 Mazzarolo
6,932,234 B2 8/2005 DAmato
6,948,633 B2 9/2005 Freek
6,959,829 B2 11/2005 Crider
7,000,522 B2 2/2006 Pfaff, Jr.
D516,910 S 3/2006 Bresler
D517,322 S 3/2006 Zettle
D519,374 S 4/2006 Hornke
D521,382 S 5/2006 Gross
D522,240 S 6/2006 Laval
7,055,715 B2 6/2006 Maravich
7,063,224 B2 6/2006 Clarke
D525,869 S 8/2006 Tedford
D527,261 S 8/2006 Hornke
7,100,787 B2 9/2006 Farnsworth
D529,391 S 10/2006 Glass
D533,777 S 12/2006 Hundley
7,156,251 B2 1/2007 Smith
7,159,732 B2 1/2007 Smith
7,175,042 B2 2/2007 Durdon
D543,787 S 6/2007 Wasserman
7,225,945 B2 6/2007 Crider
7,232,302 B2 6/2007 Marzona
7,284,676 B2 10/2007 Dantani
D556,574 S 12/2007 Hollis
D559,105 S 1/2008 D'Amato
D560,120 S 1/2008 Maravich
7,318,536 B2 1/2008 Maravich
7,318,563 B2 1/2008 Houts
7,328,791 B1 2/2008 Bosworth
D564,354 S 3/2008 Maravich
7,353,582 B2 4/2008 MacKenzie
D569,245 S 5/2008 Joshi
D570,685 S 6/2008 Koennecke
D570,686 S 6/2008 Hollis
D574,231 S 8/2008 Laval
D574,238 S 8/2008 Walker
D574,290 S 8/2008 Shah
D578,829 S 10/2008 Freeman
7,455,006 B2 11/2008 Toth
7,464,831 B2 12/2008 Aiken
7,484,639 B2 2/2009 Maravich
D588,002 S 3/2009 D'Amato
7,513,382 B2 4/2009 Clarke
D591,476 S 5/2009 Colman
D592,952 S 5/2009 Hundley
D593,892 S 6/2009 Schneider
7,549,559 B2 6/2009 Conroy
D596,524 S 7/2009 Schneider
7,676,909 B2 3/2010 MacKenzie
D613,199 S 4/2010 Schneider
7,691,302 B2 4/2010 Hollis
7,784,641 B2 8/2010 Chou
D624,413 S 9/2010 Selina
7,819,271 B2 10/2010 Hollis
7,845,514 B2 12/2010 Rush
7,992,741 B2 8/2011 Hundley
8,038,432 B2 10/2011 Mazzarolo
8,074,331 B2 12/2011 Voges
8,074,831 B2 12/2011 Walker
8,113,379 B2 2/2012 Cai
8,196,500 B2 6/2012 Mansfield
8,211,355 B2 7/2012 Otto
8,276,776 B2 10/2012 Roth
8,282,382 B2 10/2012 Mazzarolo
8,317,050 B2 11/2012 Hollis
8,430,268 B2 4/2013 Weiss
D685,286 S 7/2013 Bhansali
8,544,677 B2 10/2013 Selina
D693,181 S 11/2013 Chase
8,616,405 B2 12/2013 French
D696,940 S 1/2014 Hale
8,628,319 B2 1/2014 Mazzarolo
D699,619 S 2/2014 Kothari
8,662,880 B2 3/2014 Fowler
D726,025 S 4/2015 Somers
9,034,231 B2 5/2015 Tabor

(56) References Cited

U.S. PATENT DOCUMENTS

| | | | |
|---|---|---|---|
| D734,894 | S | 7/2015 | Schlatter |
| D737,689 | S | 9/2015 | Monteparo |
| D744,288 | S | 12/2015 | Rosen |
| D793,899 | S | 8/2017 | Tilbrook |
| 9,814,334 | B2 | 11/2017 | Eickhoff |
| 9,815,239 | B2 | 11/2017 | Borse |
| D838,591 | S | 1/2019 | Lee |
| D845,128 | S | 4/2019 | Eickhoff |
| 10,286,593 | B2 | 5/2019 | Topolkaraev |
| D850,260 | S | 6/2019 | Eickhoff |
| D867,873 | S | 11/2019 | Troudt |
| D885,911 | S | 6/2020 | Silva |
| D885,912 | S | 6/2020 | Silva |
| 2001/0001376 | A1 | 5/2001 | Kneppe |
| 2002/0027139 | A1 | 3/2002 | ONeill |
| 2002/0037378 | A1 | 3/2002 | Littlejohn |
| 2002/0184985 | A1 | 12/2002 | Ishibuchi |
| 2002/0189957 | A1 | 12/2002 | Gordon |
| 2003/0062272 | A1 | 4/2003 | Gordon |
| 2003/0089714 | A1 | 5/2003 | Dart |
| 2003/0089726 | A1 | 5/2003 | Mazzarolo |
| 2003/0155353 | A1 | 8/2003 | Tucker |
| 2003/0192890 | A1 | 10/2003 | Mazzarolo |
| 2004/0011803 | A1 | 1/2004 | DAmato |
| 2004/0094553 | A1 | 5/2004 | Crider |
| 2004/0134911 | A1 | 7/2004 | Padovani |
| 2004/0159080 | A1 | 8/2004 | Stewart |
| 2004/0178199 | A1 | 9/2004 | Stroup |
| 2004/0217033 | A1 | 11/2004 | Gordon |
| 2004/0222226 | A1 | 11/2004 | Gottainer |
| 2004/0245261 | A1* | 12/2004 | Stanos ..... B65D 43/0208 220/793 |
| 2005/0051442 | A1 | 3/2005 | Gordon |
| 2005/0082177 | A1 | 4/2005 | Weiss |
| 2005/0092749 | A1 | 5/2005 | Durdon |
| 2005/0109780 | A1 | 5/2005 | Pendergrass |
| 2005/0155969 | A1 | 7/2005 | Clarke |
| 2005/0167294 | A1 | 8/2005 | Swayne |
| 2005/0178766 | A1 | 8/2005 | Washington |
| 2005/0210085 | A1 | 9/2005 | Bessiere |
| 2005/0224505 | A1 | 10/2005 | Brown |
| 2005/0230406 | A1 | 10/2005 | Maravich |
| 2005/0263413 | A1 | 12/2005 | Harman |
| 2005/0269328 | A1 | 12/2005 | Crider |
| 2006/0071008 | A1 | 4/2006 | Sadlier |
| 2006/0060589 | A1 | 5/2006 | Lee |
| 2006/0096983 | A1 | 5/2006 | Patterson |
| 2006/0180028 | A1 | 8/2006 | Burchard |
| 2006/0213908 | A1 | 9/2006 | Clarke |
| 2006/0226148 | A1 | 10/2006 | Hundley |
| 2006/0255038 | A1 | 11/2006 | Hollis |
| 2007/0007298 | A1 | 1/2007 | Tucker |
| 2007/0034629 | A1 | 2/2007 | Mazzarolo |
| 2007/0062943 | A1 | 3/2007 | Bosworth |
| 2007/0075080 | A1 | 4/2007 | Farnsworth |
| 2007/0107578 | A1 | 5/2007 | Koelsch |
| 2008/0035681 | A1 | 2/2008 | Skillin |
| 2008/0097516 | A1 | 4/2008 | Chang |
| 2008/0105696 | A1 | 5/2008 | Dart |
| 2008/0197134 | A1 | 8/2008 | Maxwell |
| 2008/0245792 | A1 | 10/2008 | Chou |
| 2009/0223961 | A1 | 9/2009 | Wang |
| 2009/0266829 | A1 | 10/2009 | Bailey |
| 2009/0272742 | A1 | 11/2009 | Dybala |
| 2009/0308882 | A1 | 12/2009 | Hundley |
| 2009/0313956 | A1 | 12/2009 | Martinez Sampedro |
| 2010/0037780 | A1 | 2/2010 | Pas |
| 2010/0255137 | A1 | 10/2010 | Mazzarolo |
| 2011/0011863 | A1 | 1/2011 | Hollis |
| 2011/0062173 | A1 | 3/2011 | Trotter |
| 2011/0124817 | A1 | 5/2011 | Dias |
| 2011/0297573 | A1 | 12/2011 | Chen |
| 2012/0024871 | A1 | 2/2012 | Hundley |
| 2012/0048856 | A1 | 3/2012 | Walker |
| 2012/0132699 | A1 | 5/2012 | Mann |
| 2012/0261417 | A1 | 10/2012 | Tabor |
| 2012/0272622 | A1 | 11/2012 | Weiss |
| 2013/0020338 | A1 | 1/2013 | French |
| 2013/0037558 | A1 | 2/2013 | Selina |
| 2013/0277380 | A1 | 10/2013 | Koestring |
| 2014/0072674 | A1 | 3/2014 | Holinda, Jr. |
| 2014/0284344 | A1 | 9/2014 | French |
| 2015/0014090 | A1 | 1/2015 | Masor |
| 2015/0344647 | A1 | 12/2015 | Maeda |
| 2016/0137364 | A1 | 5/2016 | Pirrella |
| 2017/0008187 | A1 | 1/2017 | Iwai |
| 2018/0022012 | A1 | 1/2018 | Rapparini |
| 2018/0050826 | A1 | 2/2018 | Hartman |
| 2018/0127161 | A1 | 5/2018 | Smith |
| 2018/0133919 | A1 | 5/2018 | Waterman |
| 2018/0290798 | A1 | 10/2018 | Peng |
| 2019/0039328 | A1 | 2/2019 | Eickhoff |

FOREIGN PATENT DOCUMENTS

| | | | |
|---|---|---|---|
| CN | 99813014 | | 9/1999 |
| DE | 20116771 | U1 | 12/2001 |
| DE | 20301404 | U1 | 5/2003 |
| EP | 1464458 | B1 | 10/2004 |
| EP | 1837138 | B1 | 9/2007 |
| FR | 2484903 | A1 | 12/1981 |
| JP | 2002241514 | A | 8/2002 |
| WO | 0018662 | | 4/2000 |
| WO | 0018663 | | 4/2000 |
| WO | 0185575 | | 11/2001 |
| WO | 03011716 | | 2/2003 |
| WO | 2004014776 | | 2/2004 |
| WO | 2005013247 | A1 | 2/2005 |
| WO | 2011149583 | | 3/2012 |

OTHER PUBLICATIONS

Japanese Office Action for Japanese App. No. 2016-502328 dated Oct. 3, 2017, 11 pages.

Office Action dated Apr. 16, 2018 for U.S. Appl. No. 15/485,299, (pp. 1-4).

Australian Search Report for Australian App. No. 2014240016 dated Aug. 25, 2017, 3 pages.

Singapore Written Opinion for Singapore Patent App. No. 11201507343Y dated Sep. 6, 2017, 6 pages.

Office action dated Jun. 14, 2017 for U.S. Appl. No. 14/921,540; (pp. 1-8).

International Search Report for PCT/US06/32565, dated May 24, 2007.

Supplementary European Search Report dated Apr. 6, 2009, for European Patent Application No. 05735742.8.

International Search Report and Written Opinion dated Jul. 9, 2008, for PCT/US2008/054888.

Supplementary European Search Report dated Jul. 28, 2008, for European Patent Application No. 06813520.1.

International Search Report and Written Opinion for International Application No. PCT/US2014/006277, dated Jul. 15, 2014, 8 pages.

Notice of Non-Final Rejection for U.S. Appl. No. 13/448,050, dated Oct. 8, 2014, 13 pages.

Notice of Non-Final Rejection for U.S. Appl. No. 13/554,771, dated Jun. 7, 2013, 14 pages.

Notice of Non-Final Rejection for U.S. Appl. No. 14/214,236, dated Oct. 3, 2014, 10 pages.

PCT International Search Report and Written Opinion completed by the ISA/US dated Jun. 19, 2014 and issued in connection with PCT/US2014/027067.

Chinese Office Action for Chinese Application No. 201480010419.3, 8 pages.

Chinse Office Action for Chinese Patent Application 201480010419.3 dated Jul. 19, 2016, 8 pages.

Office Action dated May 15, 2017 for U.S. Appl. No. 14/214,236.

Chinese Office Action for Chinese App. No. 201480010419.3 dated Dec. 22, 2016, 4 pages.

Extended European Search Report for European Patent Application No. 14768275.1, dated Sep. 14, 2016, 7 pages.

(56) References Cited

OTHER PUBLICATIONS

Office Action dated Sep. 30, 2016 for U.S. Appl. No. 14/214,236.
Office Action dated Jan. 16, 2018 for U.S. Appl. No. 14/214,236; (pp. 1-13).
Russian Office Action and Search Report for Russian App. No. 2015134775 dated Mar. 13, 2018, 10 pages.
Japanese Office Action for Japanese App. No. 2016-502328 dated Mar. 6, 2018, 4 pages.
Office Action dated Apr. 3, 2017 for U.S. Appl. No. 14/921,540.
Australian Search Report for Australian App. No. 2014240016 sent Mar. 17, 2017, 3 pages.
Office Action dated Jul. 5, 2018 for U.S. Appl. No. 29/599,942, (pp. 1-4).
Blogspot. The Herman Letters. Jul. 12, 2011 [earliest online date], [site visited Jul. 23, 2018]. Available from Internet, <URL: http://theherrnanletters.blogspot.corn/2011/07/ipost-190-is-mcdonalds-selling-p.html>. (Year: 2011).
Office Action dated Jul. 27, 2018 for U.S. Appl. No. 29/599,948, (pp. 1-5).
Office Action dated Nov. 30, 2018 for U.S. Appl. No. 29/599,948, (pp. 1-5).
First Examination Report for Indian App. No. 8804/DELNP/2015 dated Oct. 30, 2019, 6 pages.
Office Action dated Sep. 12, 2019 for U.S. Appl. No. 15/946,023, (pp. 1-15).
Third Party Submission Under 37 CFR 1.290 in U.S. Appl. No. 16/057,122, dated Apr. 16, 2020, 49 pages.
Office Action dated Aug. 6, 2020 for U.S. Appl. No. 16/736,849, (pp. 1-18).
Office Action dated Aug. 20, 2020 for U.S. Appl. No. 16/057,122, (pp. 1-20).
Polymer Properties of Omnexus—Transparency (https://web.archive.Org/web/20170406012756/https://omnexus.specialchem.com/ polymer-properties/properties/transparency, available in public at least on or after Apr. 6, 2017) (Year: 2017).
Polymer Properties of Omnexus—Haze (https://web.archive.Org/web/20170519201652/https://omnexus.specialchem.com/ polymer-properties/properties/haze, available in public at least on or after May 19, 2017) (Year: 2017).
Impact Plastics Blog (http://blog.impactplastics-ct.com/blog/basic-guide-to-the-three-main-grades-of-polypropylene-resin, available in public from the date May 16, 2017) (Year: 2017).
Chartier Octagonal Wall Modern and Contemporary Accent Mirror: Site Visited [Sep. 14, 2020. Available from Internet URL: https://www.wayfair.com/decor-pillows/pdp/eichholtz-chartier-octagonal-wall-modern-and-contemporary-accent-mirror-eitz2666.html.
Nathan Wall Mounted Mirror: Announced Jul. 2, 2020 [online]. Site Visited [Sep. 14, 2020], Available from Internet URL: https://www.wayfair.com/decor-pillows/pdp/house-of-hampton-nathan-wall-mounted-mirror-hmpt5079.html.
International (PCT) Search Report and Written Opinion for PCT/2020/016769 dated May 27, 2020, 12 pages.
Solo 668NS: Site Visited [Apr. 30, 2020]. Available from Internet URL: https://www.dartcontainer.com/products/foodservice-catalog/accessories/lids/solo-pet-plastic-flat-cold-cup-lids/668ns/ 1/2.
Single Use Spill REsistant Flat Lid_Berry Global: Site Visited [Apr. 30, 2020]. Available from Internet URL: https://catalog.berryglobal .com/products/lid/liddrink/dlt308srcp.
Thermoform Strawless Lid with Straw Slot_Berry Global: Site Visited [Apr. 30, 2020]. Available from Internet URL: https://catalog.berryglobal .com/products/lid/liddrink/dlt402ssl p.
International Search Report and Writen Opinion dated Apr. 29, 2020, 11 pages.
Canadian Filing of Prior Art Under Section 34.1(1) of the Canadian Patent Act by Third Party, Aug. 7, 2020, 20 pages.
European Search Report for European App. No. 18780978.5 dated Jan. 28, 2021, 8 pages.
International (PCT) Search Report and Written Opinion for PCT/US20/46469 dated Nov. 30, 2020, 9 pages.
European Search Report for European App. No. 18844658.7 dated Apr. 4, 2021, 11 pages.
European First Substantive Examination Report for European App. No. 18780978.5 dated Aug. 24, 2021, 4 pages.
Chinese Office Action for Chinese Patent App. No. 20180065303.8 dated Jun. 15, 2021, 12 pages.

* cited by examiner

DRINK CUP LID

PRIORITY CLAIM

This application is a continuation of U.S. application Ser. No. 14/209,984, filed Mar. 13, 2014 which claims priority under 35 U.S.C. § 119(e) to U.S. Provisional Application Ser. No. 61/801,433, filed Mar. 15, 2013, each of which is expressly incorporated by reference herein.

BACKGROUND

The present disclosure relates to drink cups, and particularly to lids for drink cups. More particularly, the present disclosure relates to a seal established between a drink cup and a lid mounted on the drink cup.

SUMMARY

According to the present disclosure, a liquid container comprises a lid adapted to mate with the brim of a cup. The cup also includes a floor and a side wall extending from the brim toward the floor.

In illustrative embodiments, the lid includes a central closure formed to include the liquid-discharge outlet and a ring-shaped brim mount arranged to surround the central closure. The brim mount of the lid is configured to mate with the brim of the cup to hold the central closure in a stationary position closing a cup mouth opening into an interior liquid reservoir chamber formed in the cup and placing the liquid-discharge outlet in fluid communication with any liquid stored in the interior liquid reservoir chamber of the cup.

In illustrative embodiments, the brim mount includes four seal rings. Three of the seal rings are configured to mate with the brim of the cup to establish three annular liquid flow barriers between the cup and the lid. Another of the seal rings on the brim mount is configured to mate with an upper portion of an interior surface of the side wall to establish another liquid flow barrier between the cup and the lid. Two of the four seal rings can be viewed as interior seal rings since they mate with interior portions of the side wall and the cup brim. Another two of the four seal rings can be viewed as exterior seal rings since they mate with exterior portions of the cup brim when the lid is mounted on the brim of the cup to close an opening into an interior liquid reservoir chamber formed in the cup.

In illustrative embodiments, two interior seal rings of the lid cooperate to form two annular liquid flow barriers on an interior portion of the cup. A first seal ring of the lid is arranged to engage a radially inwardly facing first annular seal surface provided at a first distance from the cup floor on the interior portion of the side wall just below a junction between the brim and the side wall of the cup. A second seal ring of the lid is located above the first seal ring. The second seal ring is arranged to engage a relatively higher radially inwardly facing second annular seal surface provided on a first brim segment included in the cup brim at a relatively greater second distance from the cup floor on the interior portion of the brim at a location above the first seal ring and below the uppermost portion of the brim.

In illustrative embodiments, two exterior seal rings of the lid cooperate to form two annular liquid flow barriers on an exterior portion of the cup brim. A third seal ring of the lid is arranged to engage a radially outwardly facing third annular seal surface provided on a second brim segment included in an exterior portion of the cup brim. A fourth seal ring of the lid is arranged to engage a radially outwardly facing fourth annular seal surface provided on a lower third brim segment including an exterior portion of the cup brim to lie below the third annular seal surface of the cup brim.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
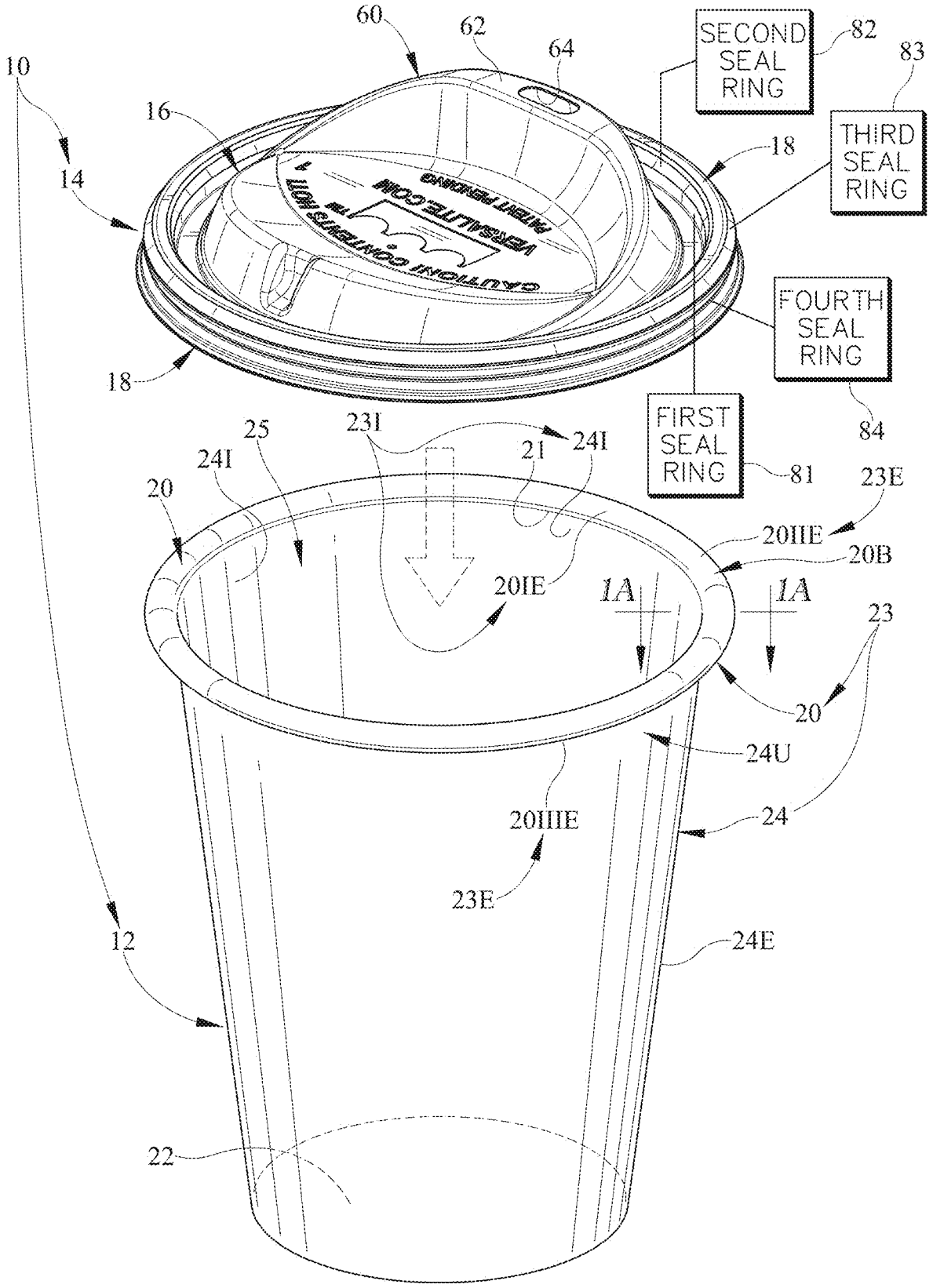
FIG. 1 is a perspective view of a lid in accordance with a first embodiment of the present disclosure and a cup before the lid is mounted on the cup and showing that the lid includes a central closure surrounded by a brim mount that is formed to include four seal rings that are shown in more detail in FIG. 4 and in mating engagement with a brim of the cup and with an interior surface of an upper interior portion of the cup side wall just below the brim in FIG. 5.

A liquid container in accordance with the present disclosure includes a cup 12 having a brim 20 and a lid including a brim mount that is configured to mate with the brim 20 of the cup 12 using an interference fit to establish a series of four annular liquid flow barriers between the lid and the cup 12. A first illustrative embodiment of a container 10 including lid 14 having a brim mount 18 is shown in FIGS. 1-6C, while a second illustrative embodiment of a container 10 including a lid 114 having a brim mount 118 is shown in FIGS. 7-14.

A liquid container 10 in accordance with a first embodiment of the present disclosure includes a cup 12 and a lid 14 as shown in FIG. 1. Lid 14 is adapted to mate with brim 20 of cup 12 as suggested in FIG. 1. Lid 14 includes a central closure 16 formed to include a liquid-discharge outlet 64 and a brim mount 18 coupled to central closure 16 and configured to be mounted on brim 20 of cup 12 to arrange central closure 16 to close a cup mouth 21 opening into an interior liquid reservoir chamber 25 formed in cup 12 as suggested in FIG. 1. Lid 14 is made of, for example, polystyrene, polypropylene, or polyethylene using a thermoforming process (or other suitable process) in illustrative embodiments. Cup 12 also includes a floor 22 and a shell 23 mating with floor 22 and comprising brim 20 and a side wall 24 extending from brim 20 toward floor 22.

Figure 2:
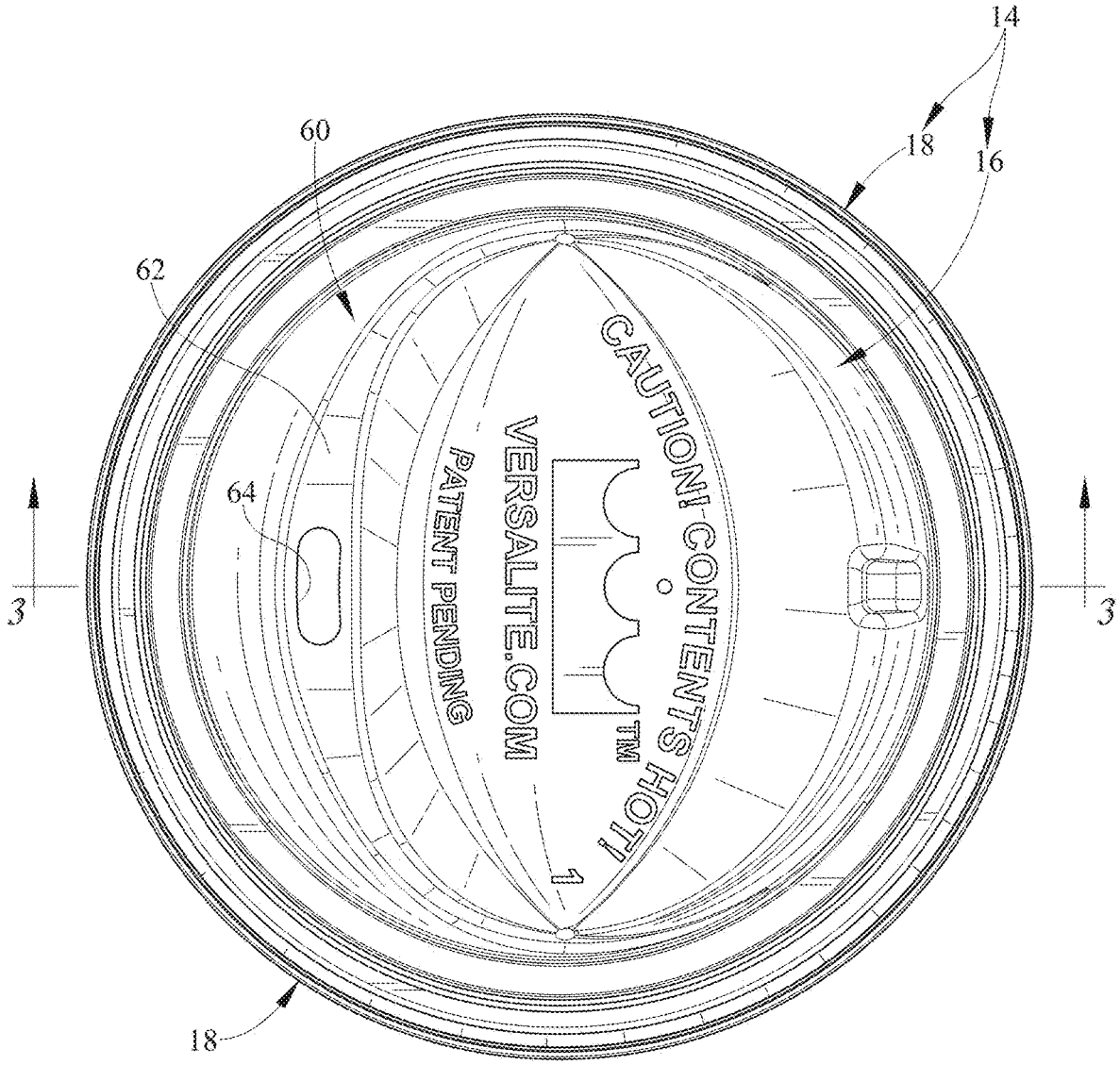
FIG. 2 is an enlarged top plan view of the lid of FIG. 1.
Figure 3:
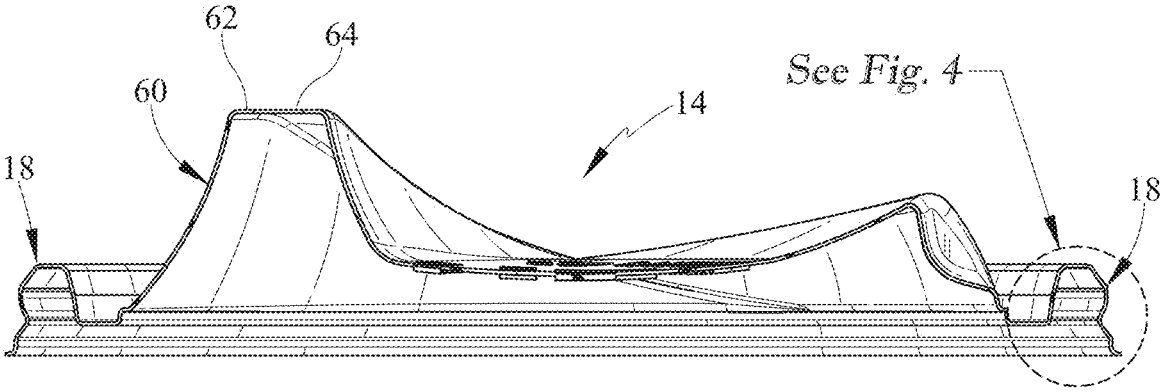
FIG. 3 is a sectional view taken along line 3-3 of FIG. 2 showing the cross-sectional shape of the brim mount of the lid.

Central closure 16 of lid 14 rises upwardly above brim mount 18 in illustrative embodiments and includes a drink spout 60 including a top wall 62 formed to include a liquid-discharge outlet 64 as suggested in FIGS. 1-3. In an illustrative embodiment, a consumer can drink liquid stored in cup 12 while lid 14 remains mounted on brim 20 of cup 12 through the liquid-discharge outlet 64 formed in lid 14. Drink spout 60 is adapted to be received in the mouth of a consumer desiring to drink a liquid stored in cup 12. Drink spout 60 is formed to include a high-elevation liquid-discharge outlet 64 and is located inside a rear semicircular portion of brim mount 18 as suggested in FIG. 2. Any liquid stored in interior liquid reservoir chamber 25 of cup 12 is in fluid communication with the liquid-discharge outlet 64 formed in top wall 62 of the upstanding drink spout 60 as suggested in FIG. 1.

As shown in FIGS. 1 and 2, cup 12 includes a brim 20, a floor 22, and a side wall 24 extending upwardly from floor 22 to brim 20. Side wall 24 and floor 22 cooperate to form interior liquid reservoir chamber 25 of cup 12. It is within the scope of this disclosure to make cup 12 out of any suitable plastics, paper, or other material(s). It is within the scope of this disclosure to mount floor 22 in a suitable location at or near a lower edge of side wall 24.

Figure 1A:
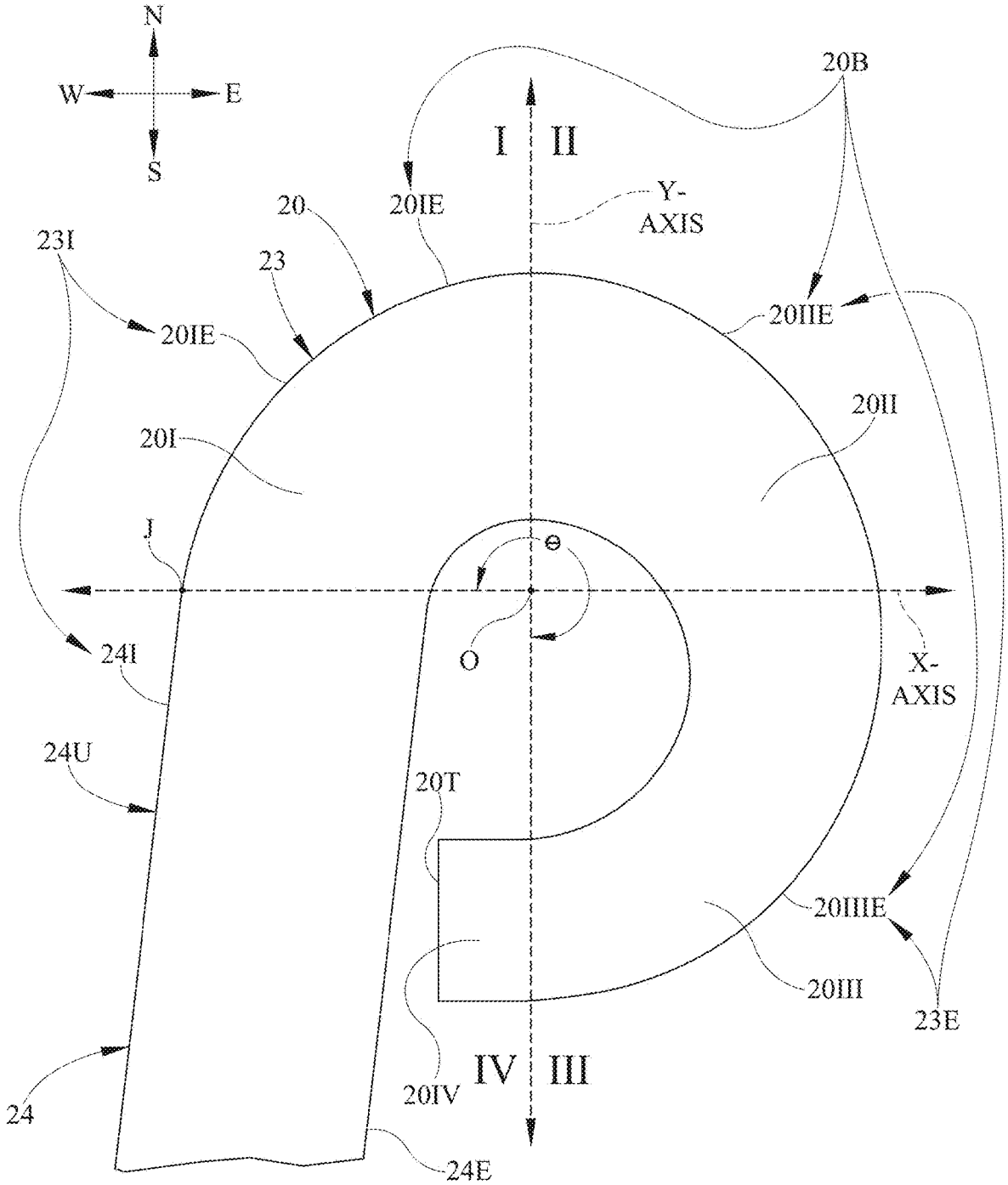
FIG. 1A is an enlarged dead section of the cup taken along line 1A-1A of FIG. 1 showing an upper portion of the cup side wall and showing the cup brim.

An illustrative cross-sectional shape of an upper portion of cup 12 taken along line 3-3 of FIG. 1 is shown in FIG. 1A. An upper portion 24U of cup side wall 24 mates with and merges into brim 20 to form, in illustrative embodiments, a monolithic hollow cup shell 23 comprising side wall 24 and brim 20. In illustrative embodiments, floor 22 of cup 12 is mated using any suitable means to a lower portion of side wall 24 to form cup 12. Thus, as suggested in FIG. 1, cup 12 comprises a shell 23 and a floor 22 coupled to shell 23 to form an interior liquid reservoir chamber 25. Shell 23 includes brim 20 and side wall 24.

Cup brim 20 is a monolithic element comprising, in series, four brim segments 20I, 20II, 20III, and 20IV as suggested in FIG. 1A. First brim segment 20I is coupled to upper portion 24U of side wall 24 of shell 23. Third brim segment 20III surrounds upper portion 24U of side wall 24 and lies in spaced-apart relation to an exterior surface 24E of upper portion 24U of side wall 24. Second brim segment 20II interconnects first and third brim segments 20I, 20III. Fourth segment 20IV is coupled to a free end of third segment 20III and includes an annular distal tip 20T that, in illustrative embodiments, is arranged to lie in spaced-apart relation to exterior surface 24E of upper portion 24U of side wall 24.

Intersecting x-axis and y-axis reference lines are provided on FIG. 1A to divide the illustrated cross section of cup brim 20 and upper portion 24U of side wall 24 into four quadrants disposed about an origin O located at the intersection of the x-axis and y-axis reference lines. First brim segment 20I is located in a northwest first quadrant (I). Second brim segment 20II is located in a northeast second quadrant (II). Third brim segment 20III is located in a southeast third quadrant (III). Fourth brim segment 20IV and upper portion 24U of side wall 24 are located in a southwest fourth quadrant (IV).

Brim 20 has a curved outer boundary surface 20B defined by, in series, a first convex curved outer surface 20IE of first brim segment 20I, a second convex curved outer surface 20IIE of second brim segment 20II, and a third convex curved outer surface 20IIIE of third brim segment 20III as shown, for example, in FIG. 1A. Curved outer boundary surface 20B of brim 20 has a rounded shape in vertical cross section that extends along a generally circular path to subtend an included angle θ of at least 180° as shown, for example, in FIG. 1A. In an illustrative embodiment, first, second, and third convex curved outer surfaces 20IE, 20IIE, and 20IIIE have a common center of curvature and cooperate to subtend an angle θ of about 270° as suggested in FIG. 1A. These outer surfaces cooperate to define an outer boundary surface characterized by a round shape.

Lid 14 includes a central closure 16 formed to include liquid-discharge outlet 64 and a ring-shaped brim mount 18 arranged to surround central closure 16 as shown, for example, in FIGS. 1 and 2. Brim mount 18 of lid 14 is configured to mate with brim 20 of cup 12 to hold central closure 16 in a stationary position closing a cup mouth 21 opening into interior liquid reservoir chamber 25 of cup 12 and placing liquid-discharge outlet 64 in fluid communication with any liquid stored in interior liquid reservoir chamber 25 of cup 12.

Figure 4:
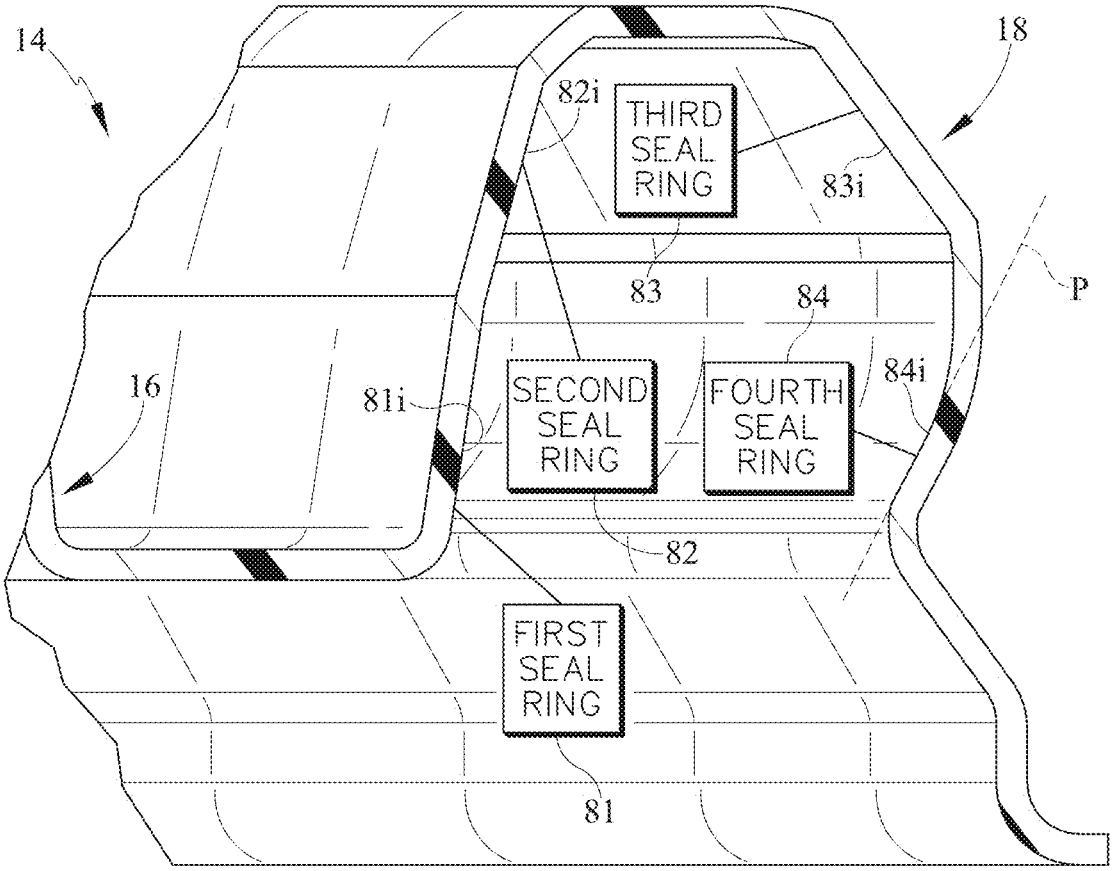
FIG. 4 is an enlarged view of a portion of the brim mount taken from the circled region of FIG. 3 showing first, second, third, and fourth seal rings included in the brim mount of the lid and adapted to mate with interior and exterior portions of the cup brim and an upper interior portion of the cup side wall as shown, for example, in FIG. 5.

Brim mount 18 of lid 14 includes four seal rings 81, 82, 83, and 84 as shown, for example, in FIG. 4. First seal ring 81 is arranged to mate with side wall 24 of cup 12 to establish an annular liquid flow barrier between cup 12 and lid 14 as suggested in FIG. 5. Each remaining seal ring 82-84 is configured to mate with brim 20 of cup 12 to establish an annular liquid flow barrier between cup 12 and lid 14 as suggested in FIG. 5. Each of seal rings 81-84 is defined by a taper as shown, for example, in FIG. 4. First, second, and fourth seal rings 81, 82, 84 are characterized by a generally positively sloping taper while third seal ring 83 is characterized by a generally negative sloping taper when viewed in the cross-sectional profile shown in FIG. 4.

Figure 5:
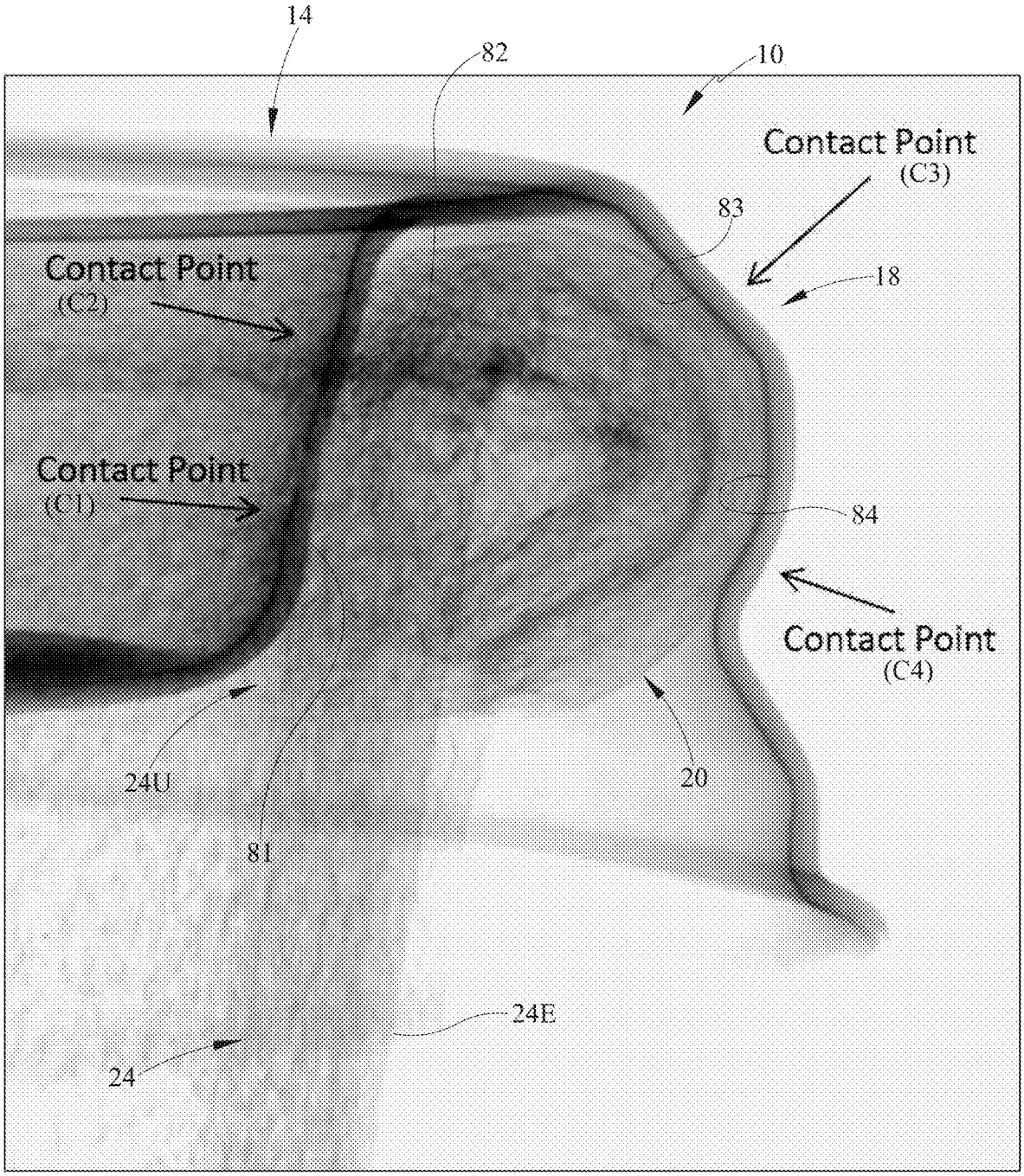
FIG. 5 is a sectional view of the brim mount of FIG. 4 mounted on a companion cup to form a liquid container in accordance with the present disclosure to show an annular contact point between each of the four seal rings included in the brim mount of the lid and companion ring-shaped portions of the cup.

First seal ring 81 is configured to mate with a tapered (e.g., frustoconical) inner surface 241 of an upper portion 24U of side wall 24 to establish an annular liquid flow barrier between cup 12 and lid 14 as shown diagrammatically in FIG. 1A and illustratively in FIG. 5. As suggested in FIG. 4, first seal ring 81 is tapered to have a steeply sloped frustoconical shape.

Second seal ring 82 is arranged to engage an annular inner sealing portion on the first convex curved outer surface 20IE of the first brim segment 20I to establish a second annular liquid flow barrier between cup 12 and lid 14. As suggested in FIG. 4, second seal ring 82 is tapered to have, for example, a frustoconical shape that is different from the frustoconical shape of the first seal ring 81 and less steep.

Third seal ring 83 is arranged to engage an annular middle sealing portion on the second convex curved outer surface 20IIE of the second brim segment 20II to establish a third annular liquid flow barrier. As suggested in FIG. 4, third seal ring 83 is tapered to have, for example, a frustoconical shape that is different from the frustoconical shapes of the first and second seal rings and less steep.

Fourth seal ring 84 is arranged to engage an annular outer sealing portion on the third convex curved outer surface 20IIIE of the third brim segment 20III to establish a fourth annular liquid flow barrier. As suggested in FIG. 4, fourth seal ring 84 is tapered to, for example, curve about a center of curvature that is located in a position between the seal rings 81-84.

Second seal ring 82 mates with an interior portion of cup brim 20 as suggested in FIG. 5. Third and fourth seal rings 83, 84 mate with an exterior portion of cup brim 20 while first seal ring 81 mates with a tapered inner surface 241 on an upper portion 24U of side wall 24 when lid 14 is mounted on brim 20 of cup 12 to close an opening 21 into an interior liquid reservoir chamber 25 formed in cup 12 as shown, for example, in FIG. 5.

When viewed from another perspective, interior seal rings 81, 82 of the lid 14 cooperate to form two annular liquid flow barriers on an interior portion 231 of cup shell 23 as suggested in FIGS. 1A, 4, and 5. A first seal ring 81 of lid 14 is arranged to engage a radially inwardly facing first annular seal surface provided at a first distance from cup floor 22 on interior portion 231 of cup shell 23 just below a junction (J) between brim 20 and side wall 24 of cup 12 as suggested in FIG. 5. A second seal ring 82 of lid 14 is located above first seal ring 81 as suggested in FIG. 4. Second seal ring 82 is arranged to engage a relatively higher radially inwardly facing second annular seal surface provided on first brim segment 20I at a relatively greater second distance from cup floor 22 on interior portion 231 of shell 23 at a location above first seal ring 81 and below the uppermost portion of brim 20 as suggested in FIGS. 4 and 5.

The two exterior seal rings 83, 84 of lid 14 when viewed from that same perspective cooperate to form two annular liquid flow barriers on an exterior portion 23E of cup shell 23 as suggested in FIGS. 1A, 4, and 5. A third seal ring 83 of lid 14 is arranged to engage a radially outwardly facing third annular seal surface provided on an upper brim segment 20II of cup brim 20. A fourth seal ring 84 of lid 14 is arranged to engage a radially outwardly facing fourth annular seal surface provided on a lower brim segment 20III of cup brim 20 to lie below the third annular seal surface of cup brim 20.

Figure 6A:
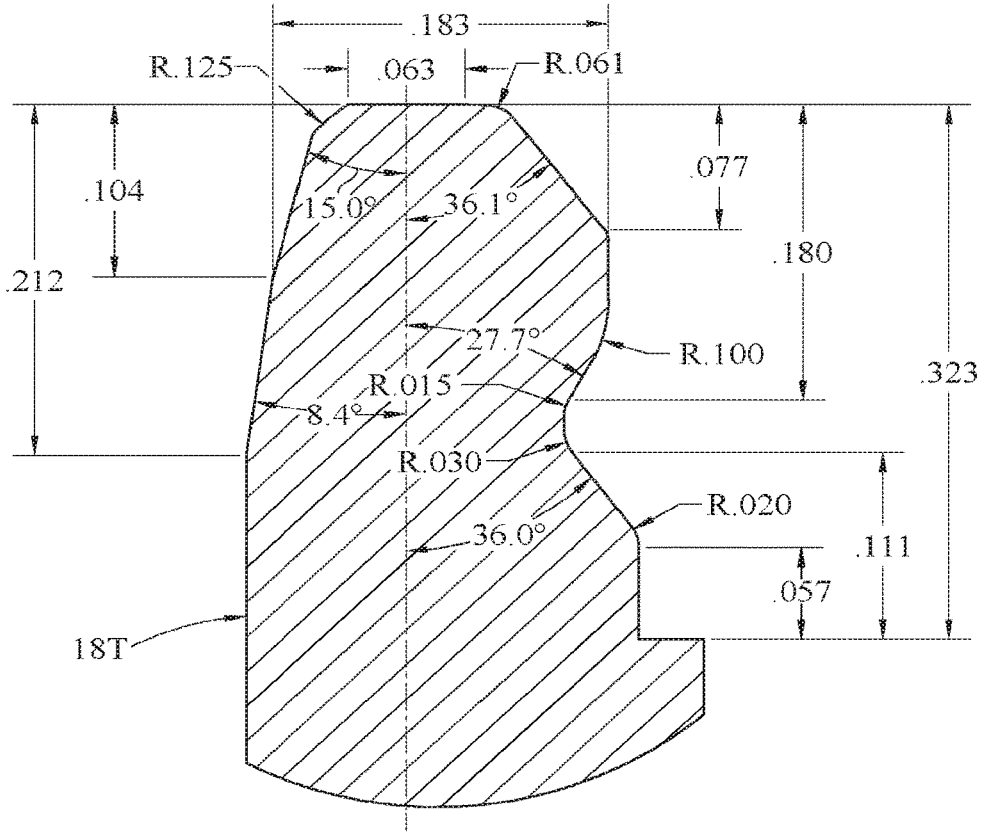
FIG. 6A shows tooling used to form the brim mount of the lid shown in FIGS. 3-5 and showing a cavity inner section (on the left) forming the inner seal and plug fit geometry of an inner part of the brim mount and a cavity outer section (on the right) forming the outer seal and snap geometry of an outer part of the brim mount.
Figure 6B:
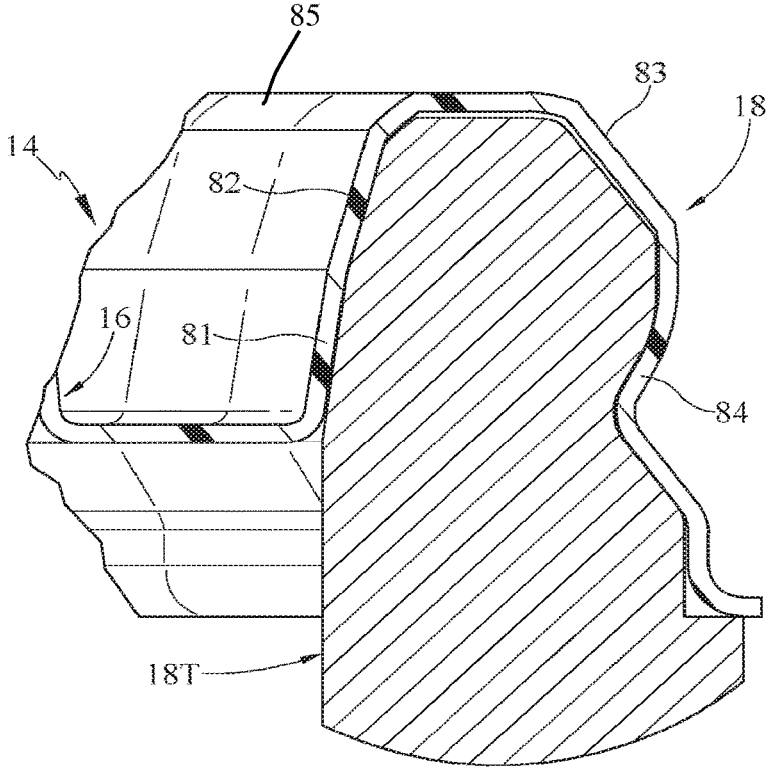
FIG. 6B shows the brim mount portion of FIG. 4 molded around the tooling portion of FIG. 6A during a lid-molding activity.

Brim mount 18 of lid 14 is mounted on a brim 20 of a companion cup 12 to form a liquid container 10 in accordance with the first embodiment of the present disclosure to show an annular contact point (C1, C2, C3, C4) between each of the four seal rings 81, 82, 83, 84 included in brim mount 18 of lid 14 and companion ring-shaped portions of brim 20 of cup 12 as suggested in FIG. 5. Tooling 18T used to form brim mount 18 of lid 14 is shown in FIGS. 6A-6B. (All dimensions are noted in inches.)

Liquid container 10 includes a cup 12 including a brim 20, a floor 22, and a side wall 24 extending from brim 20 toward floor 22 as shown, for example, in FIG. 1. Side wall 24 includes a frustoconical inner surface 241 cooperating with floor 22 to form an interior liquid reservoir chamber 25 of cup 12. Brim 20 includes a curved outer boundary surface 20B mating with an uppermost portion 24U of the frustoconical inner surface 241 of side wall 24 and extending away from the uppermost portion 24U as suggested in FIGS. 1 and 1A.

The curved outer boundary surface 20B of brim 20 has a rounded shape in vertical cross section that extends along a generally circular path subtends an angle θ of at least 180° as suggested in FIG. 1A. The curved outer boundary surface 20B of brim 20 has an annular inner sealing portion 20IE adjacent to the frustoconical inner surface 241 of side wall 24, an annular outer sealing portion 20IIIE away from the inner sealing portion 20IE, and an annular middle sealing portion 20IIE interposed between the annular inner and outer sealing portions 20IE, 20IIIE as suggested in FIG. 1A.

Liquid container 10 also includes a lid 14 including a central closure 16 as suggested in FIG. 1. Brim mount 18 is configured to be mounted on the curved outer boundary surface 20B of brim 20 to retain central closure 16 in a position closing a mouth 21 opening into the interior liquid reservoir chamber 25 formed in cup 12. Brim mount 18 includes a first seal ring 81 arranged to engage the uppermost portion 24U of the frustoconical inner surface 241 of side wall 24 to establish a first annular liquid flow barrier between lid 14 and cup 12, a second seal ring 82 arranged to engage the annular inner sealing portion 20IE of the curved outer boundary surface 20B of brim 20 to establish a second annular liquid flow barrier between lid 14 and cup 12, a third seal ring 83 arranged to engage the annular middle sealing portion 20IIE of the curved outer boundary surface 20B of brim 20 to establish a third annular liquid flow barrier between lid 14 and cup 12, and a fourth seal ring 84 arranged to engage the annular outer sealing portion 20IIIE of the curved outer boundary surface 20B of brim 20 to establish a fourth annular liquid flow barrier between lid 14 and cup 12.

Each seal ring 81-84 is tapered to define a sloped inner surface that mates with a companion surface of cup 12 to establish one of the first, second, third, and fourth annular liquid flow barriers between lid 14 and cup 12 when lid 14 is mounted on cup 12 as suggested in FIGS. 4 and 5. The sloped inner surface of each of the first, second, and fourth seal rings has a generally positive slope and the sloped inner surface of the third seal ring 83 has a generally negative slope in a selected cross-sectional profile of brim mount 18 as shown, for example, in FIG. 4.

The slope of the second seal ring 82 is steeper than the slope of the fourth seal ring 84 and the slope of the first seal ring 81 is steeper than the slope of each of the second and fourth seal rings 82, 84 as suggested in FIG. 4. Each of the first, second, and third seal rings 81-83 has a frustoconical shape and the fourth seal ring has a curved shape.

Fourth seal ring 84 has a concave shape and the generally negative slope of the fourth seal ring 84 is established by a plane (P) tangent to the fourth seal ring 84 as suggested in FIG. 4. Fourth seal ring 84 is arranged to face toward each of the first, second, and third seal rings 81-83 as suggested in FIG. 4. First seal ring 81 is arranged to face toward the fourth seal ring 84 and away from the second and third seal rings 82, 83. Second seal ring 82 is arranged to face toward the third and fourth seal rings 83, 84 and away from the first seal ring 81. Third seal ring 83 is arranged to face toward the first and second seal rings 81, 82 and away from the fourth seal ring 84.

Each of the first, second, and third seal rings 81-83 has a frustoconical shape as suggested in FIG. 4. Fourth seal ring 84 has a curved shape to present a concave surface in mating engagement with the annular outer sealing portion 20IIIE of the curved outer boundary surface 20B of brim 20 of cup 12. Lid 14 is made of an elastic plastics material. Each of the first, second, third, and fourth seal rings 81-84 has an undeflected shape preparatory to mating engagement of brim mount 18 of lid 14 and cup 12 as suggested in FIG. 4. Each of the first, second, third, and fourth seal rings 81-84 has a different deflected shape once brim mount 18 of lid 14 is engaged with cup 12 to assume a mounted position on the cup 12 as suggested in FIGS. 5 and 6C. A variation of about 0.010 inch between the undeflected and deflected shapes of each of the first, second, third, and fourth seal rings 81-84 defines an interference fit established between brim mount 18 of lid 14 and brim 20 of cup 12 when lid 14 is mounted on cup 12. The sloped inner surface of each of the first, second, and fourth seal rings 81, 82, 84 has a generally positive slope and the sloped inner surface of the third seal ring 83 has a generally negative slope in a selected cross-sectional profile of brim mount 18.

The drink cup lid seal geometry established in accordance with the present disclosure and embodied in brim mount 18 of lid 14 facilitates mating engagement of cup brim 20 and brim mount 18 when lid 14 is mounted on cup 12 to allow the lidded cup to pass a leak test such as the well-known Montreal leak test. Users of drink cups object when lidded cups filled with liquid, particularly hot liquid, leak at the seal. This is especially frustrating for consumers when the sip spout of the lid is aligned with a vertical seam of the side wall of the cup.

In a Montreal leak test, with the lid sip spout set at the cup seam, the cup is filled and held at a 45°-75° angle relative to horizontal. The cup is filled with hot water and the number of drops that leak during a ten second interval is recorded. The Montreal leak test allows for up to two drops to fall when setting the cup down on the testing surface.

As suggested in FIG. 5, lid geometry is established in accordance with the present disclosure to provide four linear formed surfaces (i.e., annular seal surfaces) defined by seal rings 81-84 of brim mount 18 of lid 14 to ensure that a seal or contact point is maintained on the somewhat variable round brim 20 of cup 12. Such a lid geometry in accordance with the present disclosure allows brim mount 18 of lid 14 to match closely the shape of round cup brim 20 to make consistent unbroken contact with a rolled or formed brim geometry that may vary from cup to cup. Lid 14 can thus be used with confidence in drink cup applications where leak resistance is important. The lid geometry disclosed herein is applicable to thermoformed lids and lids formed in other ways.

Figure 6C:
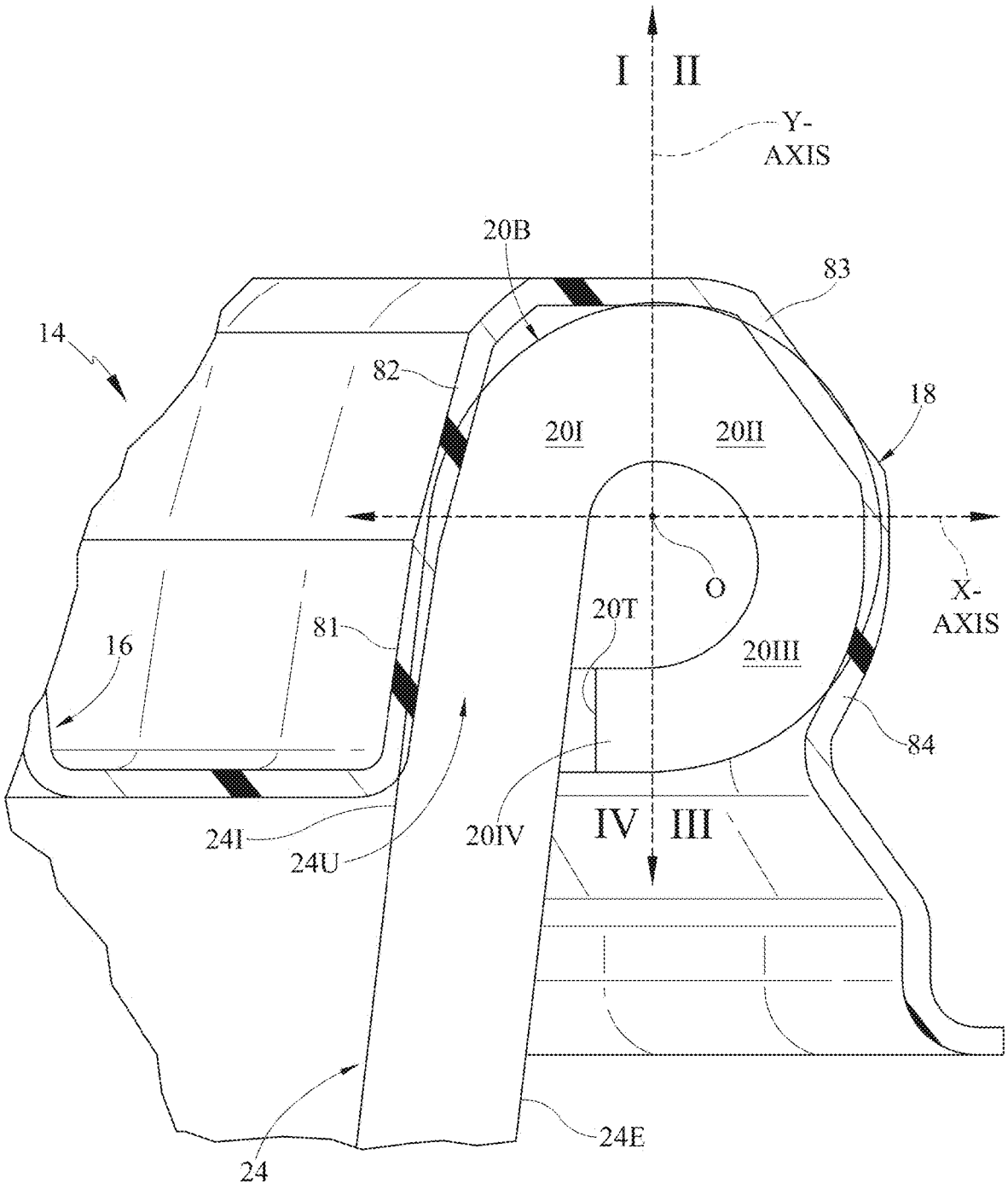
FIG. 6C is a diagrammatic illustration showing an interference-fit condition that is established between the lid and cup shown in FIG. 1 when the lid is mounted on the cup.

Lid 14 is maintained in sealing contact with cup 12 to establish a series of annular liquid flow barriers using an interference fit a suggested diagrammatically in FIG. 6C. The designed interference between brim mount 18 of lid 14 and brim 20 of cup 12 at annular contact points C1, C2, C3, and C4 is about 0.010 inch in an illustrative embodiment.

In illustrative embodiments, lid 14 is a reclosable lid hat is thermoformed using, for example, a polypropylene material. The geometry of brim mount 18 has been established in accordance with the present disclosure to pass a Montreal leak test and to be used on cups holding both cold and hot liquids. Another example of a lid 114 and its brim mount 118 made with a leak-resistant geometry in accordance with the present disclosure is shown in FIGS. 7-14 and is described herein.

Figure 7:
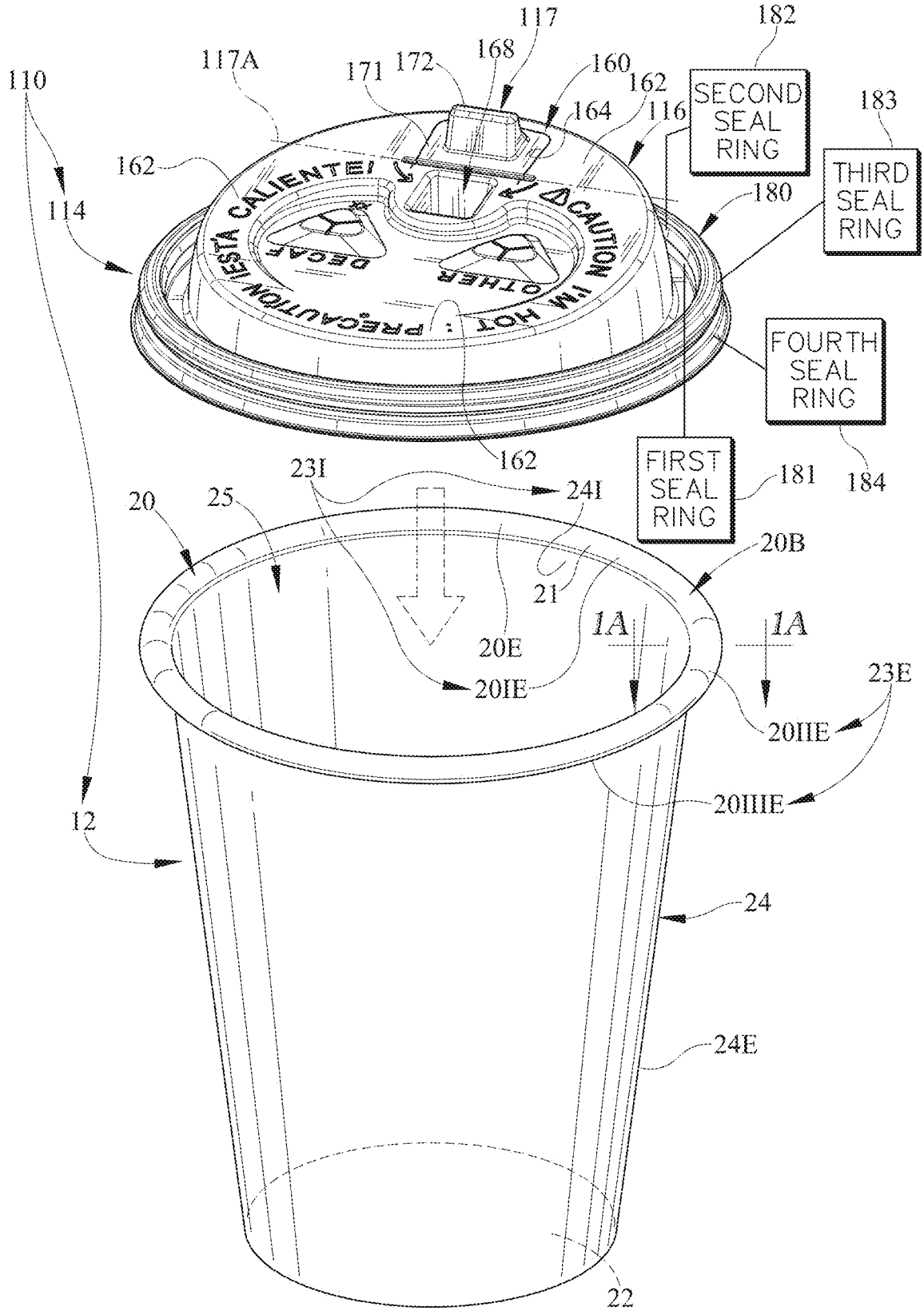
FIG. 7 is a perspective view of a lid in accordance with a second embodiment of the present disclosure and a cup before the lid is mounted on the cup and showing that the lid includes a ring-shaped brim mount adapted to mate with the brim of the cup and a central closure surrounded by the brim mount and that the brim mount is formed to include four seal rings that are shown in more detail in FIG. 10 and in mating engagement with a brim of a cup and with an interior surface of an upper interior portion of the cup side wall just below the brim in FIG. 10.

A liquid container 110 in accordance with a second embodiment of the present disclosure includes a cup 12 and a lid 114 as shown in FIG. 7. Lid 114 includes a central closure 116 formed to include a liquid-discharge outlet 164, a pivotable outlet closure 117, and brim mount 180 coupled to central closure 116 and configured to be mounted on a brim 20 of cup 12 to arrange central closure 116 to close a cup mouth 21 opening into an interior liquid reservoir chamber 25 formed in cup 12 as suggested in FIG. 7. Lid 114 is made of, for example, polystyrene, polypropylene, or polyethylene using a thermoforming process (or other suitable process) in illustrative embodiments.

Figure 8:
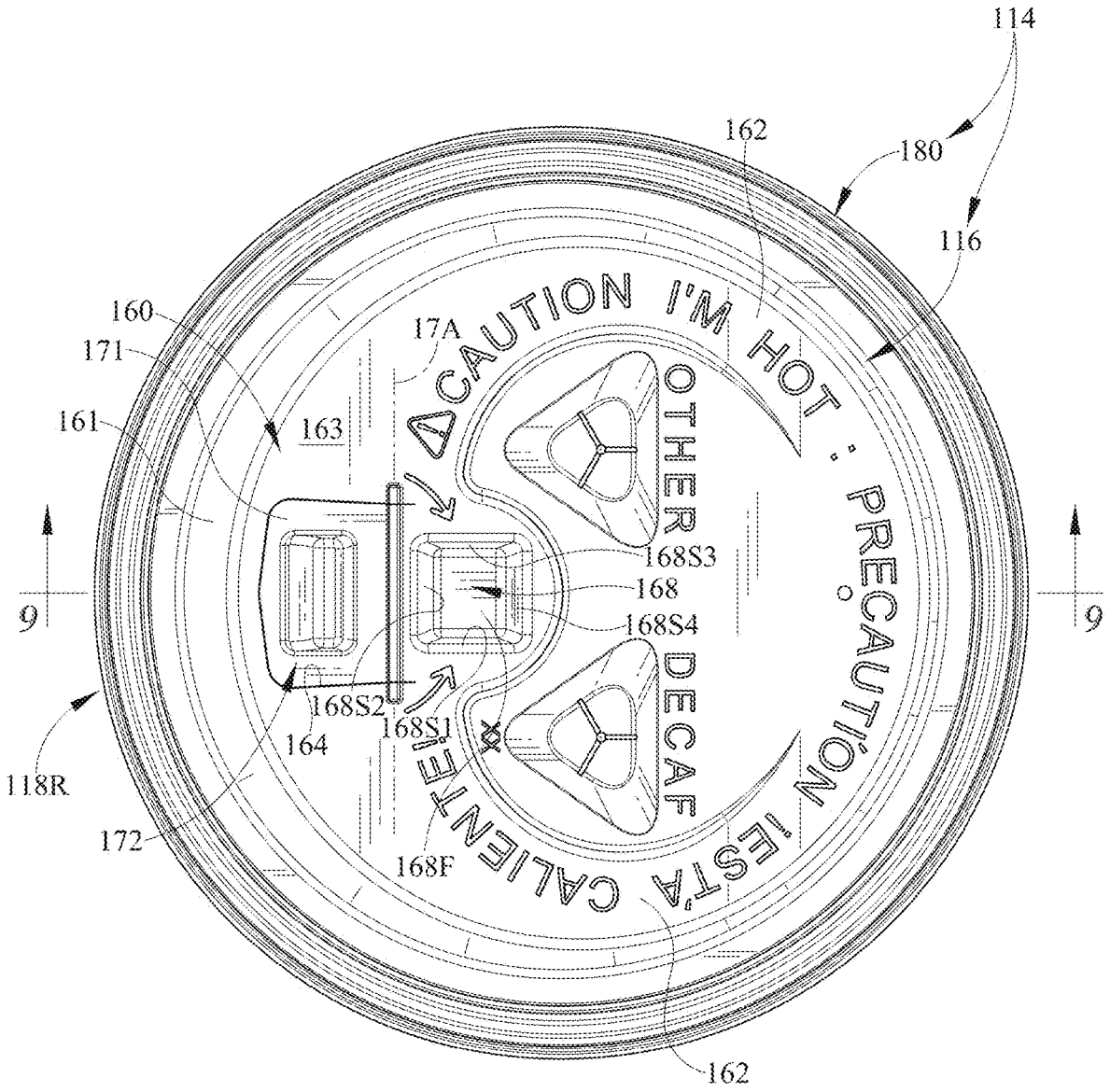
FIG. 8 is an enlarged top plan view of the lid of FIG. 7.
Figure 9:
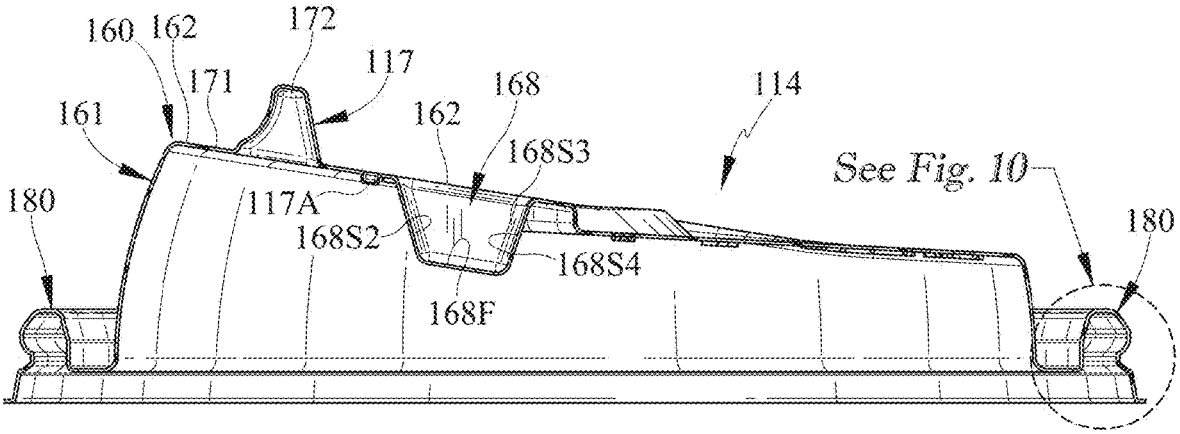
FIG. 9 is an enlarged sectional view taken along line 9-9 of FIG. 8 showing the cross-sectional shape of the brim mount of the lid.

Central closure 116 includes a drink spout 160 including an inclined top wall 162 formed to include a liquid-discharge outlet 164 and to include a closure retainer 168 as suggested in FIGS. 7-9. Inclined top wall 162 slopes downwardly toward brim mount 180 from a high point at liquid-discharge outlet 164 as suggested in FIGS. 7 and 8. Outlet closure 117 is mounted on central closure 116 for pivotable movement about pivot axis 117A between a closed position closing liquid-discharge outlet 164 as shown in FIGS. 7-9 and 13 and an opened position opening liquid-discharge outlet 164 and mating with the closure retainer 168 provided on inclined top wall 162 of drink spout 160 to retain outlet closure 117 in an opened position as shown in FIG. 14.

As shown in FIGS. 7 and 8, cup 12 includes a brim 20, a floor 22, and a side wall 24 extending upwardly from floor 22 to brim 20. Side wall 24 and floor 22 cooperate to form interior liquid reservoir chamber 25 of cup 12. Brim 20 and an upper portion 24U of side wall 24 are shown in more detail in FIG. 1A and described herein. It is within the scope of this disclosure to make cup 12 out of any suitable plastics, paper, or other material(s).

Figure 14:
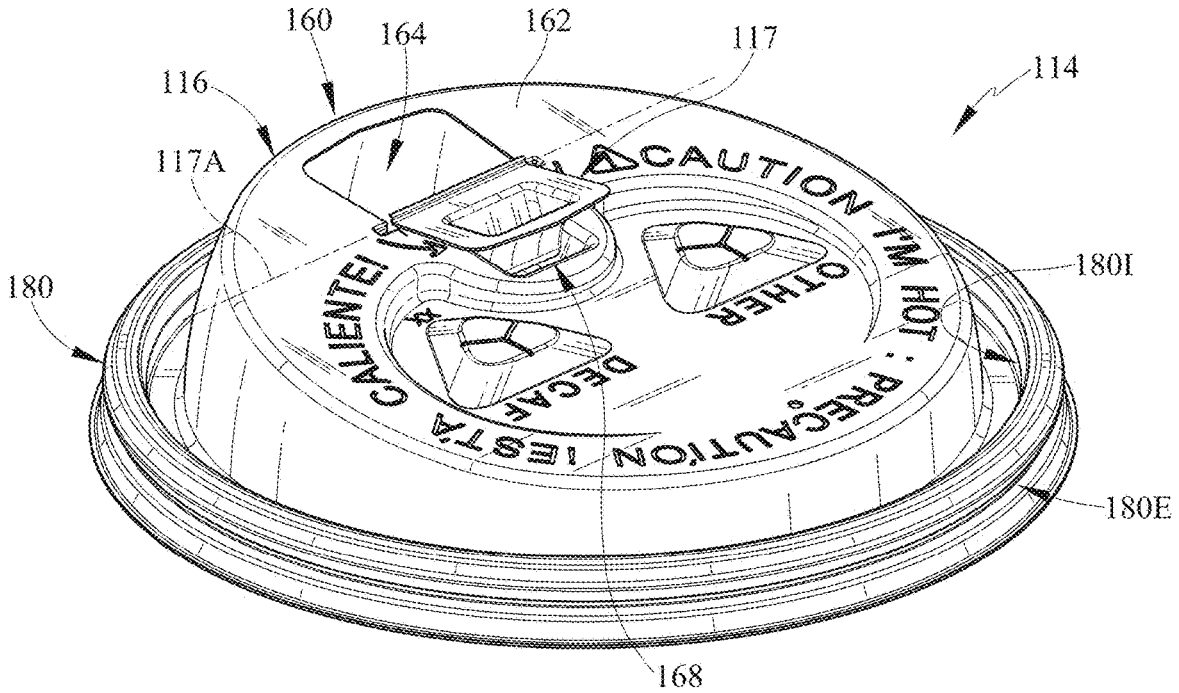
FIG. 14 is a perspective view of the lid similar to FIG. 13 showing the outlet closure after it has been pivoted in a forward direction about a horizontal pivot axis to an outlet-opening position opening the liquid-discharge outlet to cause a nose-shaped push lug included in the outlet closure to extend into a lug-receiving cavity formed in the inclined top surface of the central closure.

In an illustrative embodiment, a consumer can drink liquid stored in cup 12 while lid 114 remains mounted on the brim 20 of cup 12 through the opened liquid-discharge outlet 164 formed in lid 114 after the consumer has pivoted outlet closure 117 to an opened position shown, for example, in FIG. 14. In an illustrative embodiment, central closure 116 of lid 114 includes a drink spout 160 formed to include liquid-discharge outlet 164. Drink spout 160 is adapted to be received in the mouth of a consumer desiring to drink a liquid stored in cup 12 once outlet closure 117 has been moved to an opened position.

Central closure 116 rises upwardly above brim mount 180 as suggested in FIGS. 7 and 9. Drink spout 160 is formed to include a high-elevation liquid-discharge outlet 164 and is located inside a rear semicircular portion 118R of brim mount 180 as suggested in FIG. 8. Any liquid stored in interior liquid reservoir chamber 25 of cup 12 is in fluid communication with the liquid-discharge outlet 164 formed in the inclined top wall 162 of the upstanding drink spout 160 as suggested in FIG. 7.

Outlet closure 117 includes an annular closure plate 171, an upstanding nose-shaped closure-anchor lug 172 coupled to an inner edge of annular closure plate 171, and a hinge 173 coupled to a forwardly facing segment of an outer edge of annular closure plate 171 and to drink spout 160 along horizontally extending pivot axis 117 as shown, for example, in FIGS. 7 and 8. Annular closure plate 171 is a flange coupled to a lower edge of upstanding nose-shaped closure-anchor lug 172 and arranged to extend outwardly therefrom to lie in substantially coplanar relation to inclined top wall 162 of drink spout 160 when outlet closure 117 occupies the closed position as suggested in FIGS. 7-9. Lid 114 is thermoformed to position outlet closure 117 normally in the closed position in an illustrative embodiment.

Closure retainer 168 is formed in inclined top wall 162 of drink spout 160 as suggested in FIGS. 7-9, 13, and 14. Closure retainer 168 is formed to include an upwardly facing lug-receiving cavity 168C bounded by four side walls 168S1, 168S2, 168S3, and 168S4 and a floor 168F arranged to mate with lower edges of side walls 168S1, 168S2, 168S3, and 168S4 as shown, for example, in FIG. 8. As suggested in FIG. 14, one or more of side walls 168S1, 168S2, 168S3, and 168S4 of closure retainer 168 are configured to cooperate to provide detent means for retaining a tip of nose-shaped closure-anchor lug 172 of outlet closure 117 in lug-receiving cavity 168C. It is within the scope of this disclosure to provide closure-anchor lug 172 with any suitable shape.

Liquid container 110 comprises a lid 114 adapted to mate with brim 20 of a cup 12 as suggested in FIG. 7. Cup 12 also includes a floor 22 and a side wall 24 mating with floor 22 and extending from brim 20 toward floor 22. Cup 12 comprises a shell 23 and a floor 22 coupled to shell 23 to form an interior liquid reservoir chamber 25. Shell 23 includes brim 20 and side wall 24. Shell 23 includes an interior portion 231 and an exterior portion 230 as described and disclosed herein.

Lid 114 includes a central closure 116 formed to include liquid-discharge outlet 164 and a ring-shaped brim mount 180 arranged to surround central closure 116 as shown, for example, in FIGS. 7 and 8. Brim mount 180 of lid 114 is configured to mate with brim 20 of cup 12 to hold central closure 116 in a stationary position closing a cup mouth 21 opening into interior liquid reservoir chamber 25 of cup 12 and placing liquid-discharge outlet 164 in fluid communication with any liquid stored in interior liquid reservoir chamber 25 of cup 12.

Figure 10:
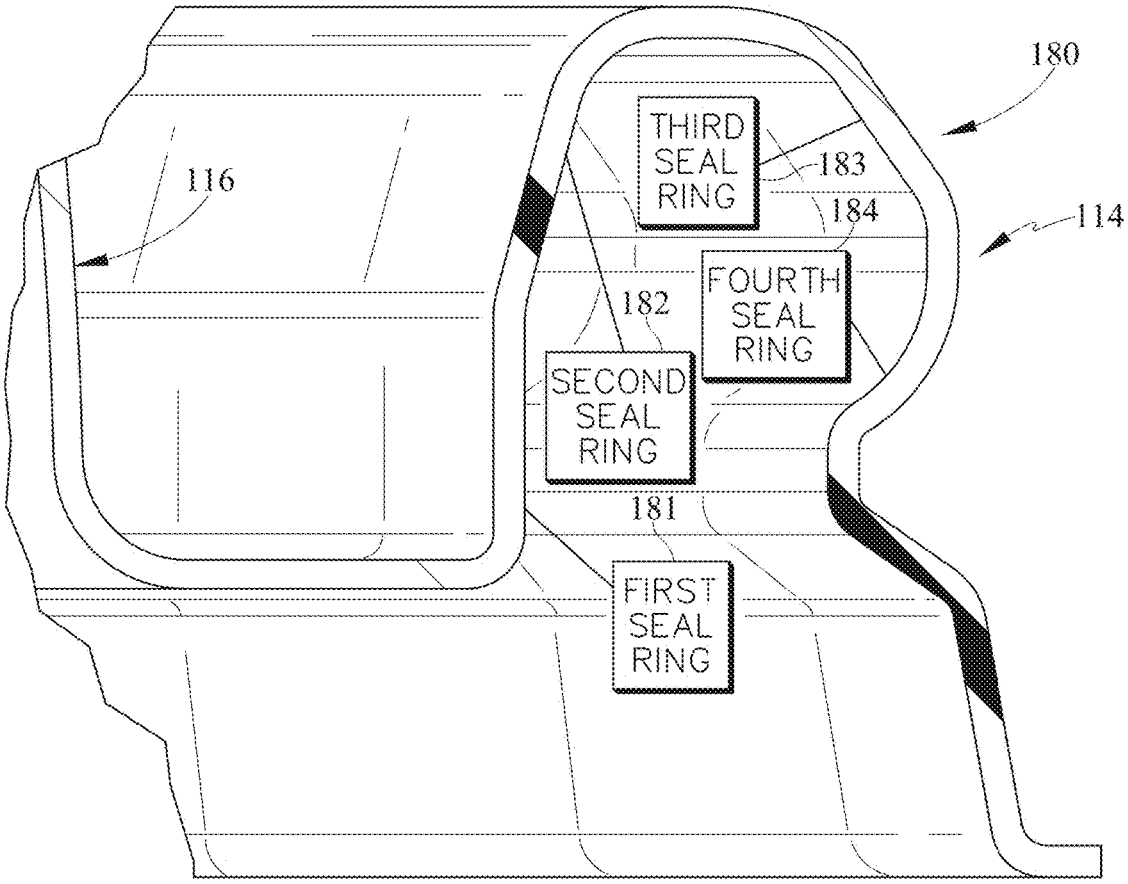
FIG. 10 is an enlarged sectional view of the portion of the brim mount circled in FIG. 9 showing the first, second, third, and fourth seal rings included in the brim mount of the lid and adapted to mate with interior and exterior portions of the cup brim and an upper interior portion of the cup side wall as shown, for example, in FIG. 11.

Brim mount 180 of lid 114 includes four seal rings 181, 182, 183, and 184 as shown, for example, in FIG. 10. First seal ring 81 is configured to mate with a frustoconical inner surface 241 of an upper portion 24U of side wall 24 to establish an annular liquid flow barrier between cup 12 and lid 14 as shown diagrammatically in FIG. 10 and illustratively in FIG. 11. As suggested in FIG. 10, first seal ring 181 has a steeply sloped frustoconical shape. Each remaining seal ring 182-184 is configured to mate with brim 120 of cup 112 to establish an annular liquid flow barrier therebetween as suggested in FIG. 11.

Second seal ring 82 is arranged to engage an annular inner sealing portion on the first convex curved outer surface 20IE of the first brim segment 20I to establish a second annular liquid flow barrier between cup 12 and lid 14. As suggested in FIG. 10, second seal ring 182 has a frustoconical shape that is different from the frustoconical shape of the first seal ring 181 and less steep.

Third seal ring 83 is arranged to engage an annular middle sealing portion on the second convex curved outer surface 20IIE of the second brim segment 20II to establish a third annular liquid flow barrier. As suggested in FIG. 10, third seal ring 183 has a frustoconical shape that is different from the frustoconical shapes of the first and second seal rings 181, 182 and less steep.

Fourth seal ring 84 is arranged to engage an annular outer sealing portion on the third convex curved outer surface 20IIIE of the third brim segment 20III to establish a fourth annular liquid flow barrier. As suggested in FIG. 10, fourth seal ring 184 is curved about a center of curvature that is located in a position between the seal rings 181-184.

Figure 11:
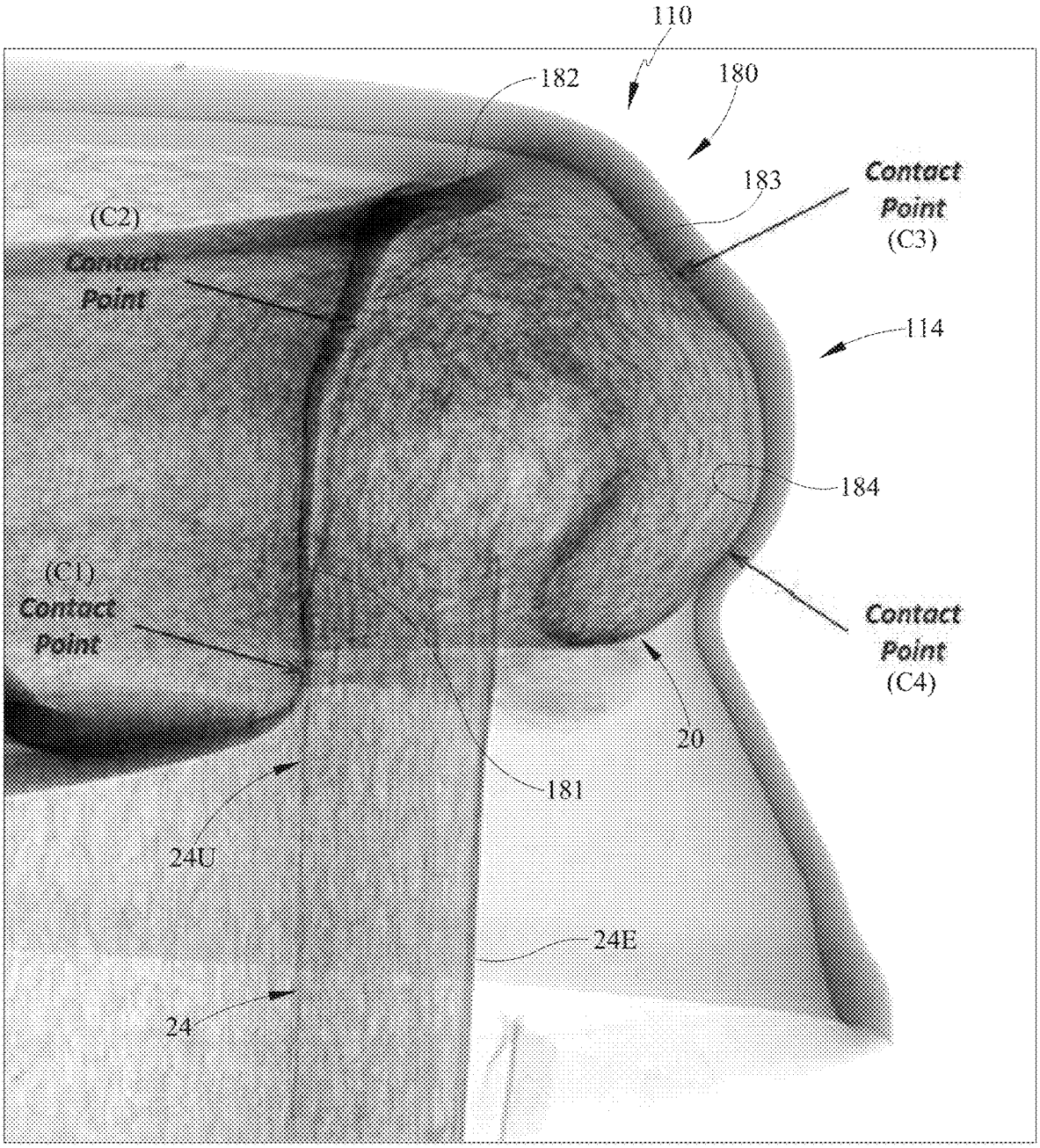
FIG. 11 is a sectional view of the brim mount of FIG. 10 mounted on a companion cup to form a liquid container in accordance with the present disclosure to show an annular contact point between each of the four seal rings included in the brim mount of the lid and companion ring-shaped portions of the cup.
Figure 12:
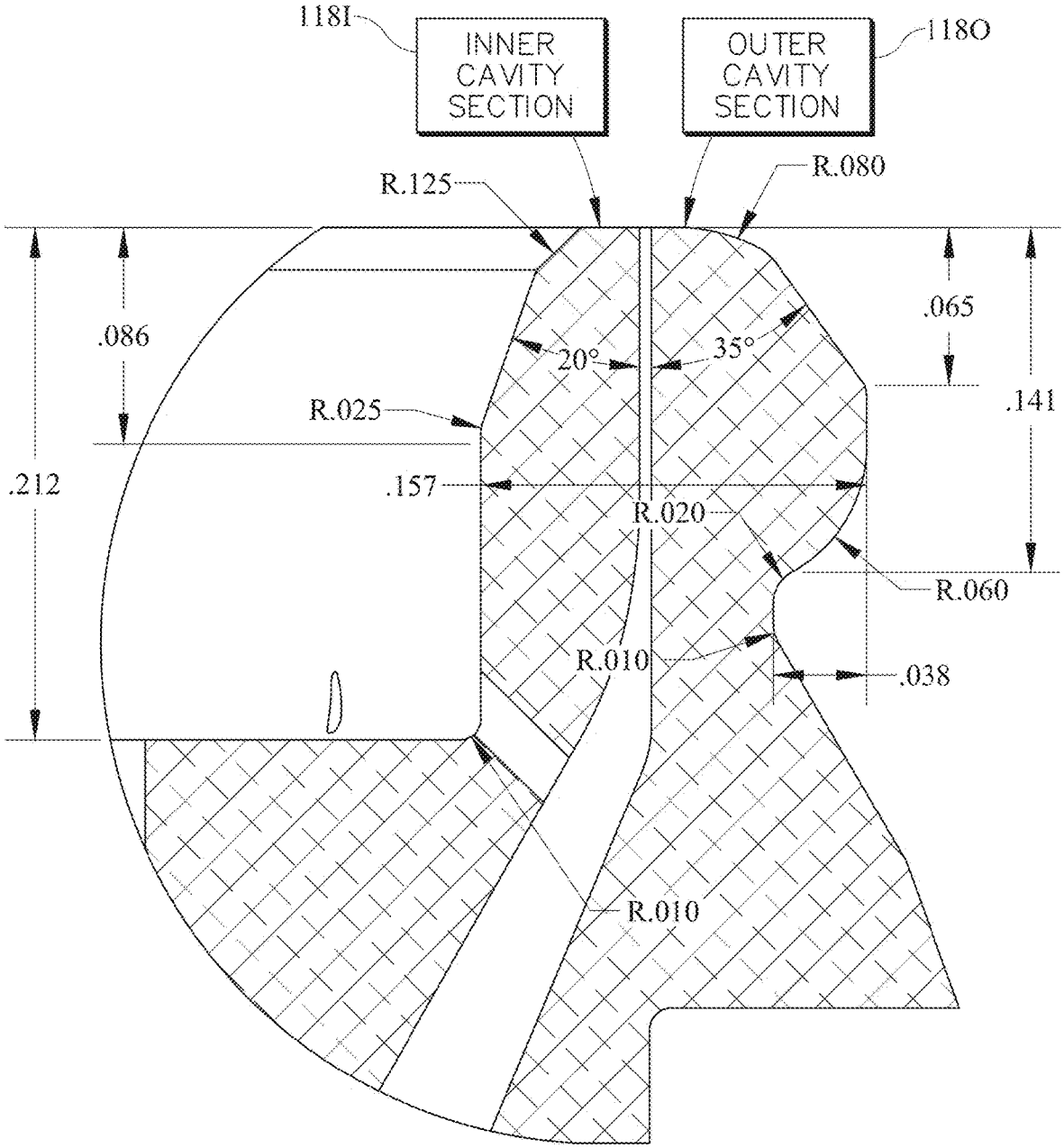
FIG. 12 shows tooling used to form the brim mount of the lid as shown in FIGS. 9-11 and showing a cavity inner section (on the left) forming the inner seal and plug fit geometry of an inner part of the brim mount and a cavity outer section (on the right) forming the outer seal and snap geometry of an outer part of the brim mount.
Figure 13:
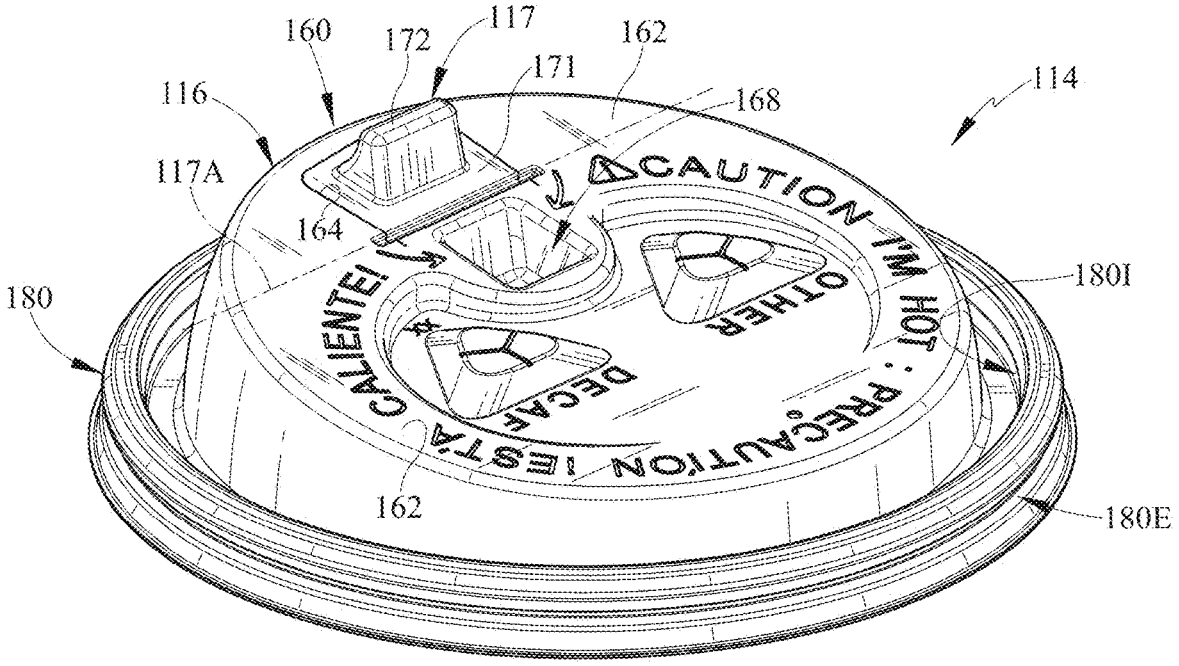
FIG. 13 is a perspective view of the lid of FIGS. 7 and 8 showing that the lid also includes an outlet closure positioned to lie at about a 10 o'clock position on an inclined top surface of the central closure in a closed position closing a liquid-discharge outlet formed in the inclined top surface of the central closure.

Second seal ring 182 mates with an interior portion of cup brim 20 as suggested in FIG. 11. Third and fourth seal rings 183, 184 mate with an exterior portion of cup brim 20 when lid 114 is mounted on brim 20 of cup 12 to close an opening 21 into an interior region 25 formed in cup 12 as shown, for example, in FIG. 11.

When viewed from another perspective, interior seal rings 181, 182 of the lid 14 cooperate to form two annular liquid flow barriers on an interior portion 231 of cup shell 23 as suggested in FIGS. 1A, 10, and 11. A first seal ring 181 of lid 114 is arranged to engage a radially inwardly facing first annular seal surface provided at a first distance from cup floor 22 on interior portion 231 of shell 23 substantially just below a junction (J) between brim 20 and side wall 24 of cup 12 as suggested in FIG. 11. A second seal ring 182 of lid 114 is located above first seal ring 181 as suggested in FIG. 10. Second seal ring 182 is arranged to engage a relatively higher radially inwardly facing second annular seal surface provided on first brim segment 20I at a relatively greater second distance from cup floor 22 on interior portion 231 of shell 23 at a location above first seal ring 181 and below the uppermost portion of brim 20 as suggested in FIGS. 10 and 11.

The two exterior seal rings 183, 184 of lid 114 cooperate to form two annular liquid flow barriers on an exterior portion 23E of cup shell 23 as suggested in FIGS. 1A, 10, and 11. A third seal ring 183 of lid 114 is arranged to engage a radially outwardly facing third annular seal surface provided on an upper brim segment 20II of cup brim 20. A fourth seal ring 184 of lid 114 is arranged to engage a radially outwardly facing fourth annular seal surface provided on a lower brim segment 20III of cup brim 20 to lie below the third annular seal surface of cup brim 20.

Brim mount 180 is mounted on a companion cup 12 to form a liquid container 110 in accordance with the second embodiment of the present disclosure to show an annular contact point (C1, C2, C3, C4) between each of the four seal rings 181, 182, 183, 184 included in brim mount 180 of lid 114 and companion ring-shaped portions of brim 20 of cup 12 as suggested in FIG. 11. Tooling used to form brim mount 180 of lid 114 is shown in FIGS. 9-11. (All dimensions are noted in inches.) A cavity inner section 1801 forms the plug fit geometry of an inner part of brim mount 180. A cavity exterior section 180E forms the seal and snap geometry of an outer part of brim mount 180 as suggested in FIGS. 13 and 14.

The invention claimed is:

1. A drink cup lid comprising a central closure and a brim mount coupled to the central closure, wherein the brim mount is adapted to be mounted on a rolled brim of a cup to retain the central closure on the cup to close a mouth opening into the cup, the rolled brim of the cup having in series, first, second and third convex outer surfaces with a common center of curvature that define an outer boundary surface of the rolled brim characterized by a round shape, the brim mount including a first seal ring with a first sloped inner surface which is adapted to engage the cup to establish a first annular liquid flow barrier between the lid and the cup, a second seal ring with a second sloped inner surface which is adapted to engage the first convex outer surface of the rolled brim of the cup to establish a second annular liquid flow barrier between the lid and the cup, a third seal ring with a third sloped inner surface which is adapted to engage the second convex outer surface of the rolled brim of the cup to establish a third annular liquid flow barrier between the lid and the cup, and a fourth seal ring with a fourth sloped inner surface which is adapted to engage the third convex outer surface of the rolled brim of the cup to establish a fourth annular liquid flow barrier between the lid and the cup, wherein one of the first sloped inner surface has a greater slope than the second sloped inner surface, the second sloped inner surface having a slope of 15 degrees from a vertical axis, and wherein the second sloped inner surface has a greater slope than the third sloped inner surface, the third sloped inner surface having a slope of 35 degrees from the vertical axis, and the second sloped inner surface having a greater slope than the fourth sloped inner surface, or the first sloped inner surface has a greater slope than the second sloped inner surface, the second sloped inner surface having a slope of 20 degrees from a vertical axis, and wherein the second sloped inner surface has a greater slope than the third sloped inner surface, the third sloped inner surface having a slope of 36.1 degrees from the vertical axis, and the second sloped inner surface having a greater slope than the fourth sloped inner surface.

2. The drink cup lid of claim 1, wherein the brim mount includes a portion between the second seal ring and the third seal ring that is configured to be spaced apart from the rolled brim when the second annular liquid flow barrier and the third annular liquid flow barriers are established.

3. The drink cup lid of claim 2, wherein the portion between the second seal ring and the third seal ring that is configured to be spaced apart from the rolled brim when the second annular liquid flow barrier and the third annular liquid flow barriers are established is substantially continuously spaced apart from the rolled brim along the length of the portion of the brim mount.

4. The drink cup lid of claim 2, wherein the portion between the second seal ring and the third seal ring is substantially planar and is attached to the third seal ring and is interconnected to the second seal ring via a second substantially planar portion formed at an angle between the second seal ring and the portion attached to the third seal ring.

5. A drink cup lid comprising a central closure and a brim mount coupled to the central closure, the brim mount sized and shaped to attach to a rolled brim of a cup, the brim mount forming a perimeter surrounding the central closure, and the brim mount including a first seal ring with a first sloped inner surface which is sized and shaped to establish a first annular liquid flow barrier between the lid and the rolled brim of the cup, a second seal ring with a second sloped inner surface which is adapted to engage the rolled brim of the cup to establish a second annular liquid flow barrier between the lid and the cup, a third seal ring with a third sloped inner surface which is sized and shaped to establish a third annular liquid flow barrier between the lid and the rolled brim of the cup, and a fourth seal ring with a fourth sloped inner surface which is sized and shaped to establish a fourth annular liquid flow barrier between the lid and the rolled brim of the cup, wherein the first seal ring, the second seal ring, and the third seal ring have frustoconical shapes, and the fourth seal ring has a curved shape and the inner surface of the fourth seal ring is concave, wherein the frustoconical shape of the first seal ring terminates at the frustoconical shape of the second seal ring, and wherein the frustoconical shape of the third seal ring terminates at the curved shape of the fourth seal ring, wherein the first sloped inner surface of the brim mount has a first slope, the second sloped inner surface of the brim mount has a second slope, the third sloped inner surface of the brim mount has a third slope, and the fourth sloped inner surface of the brim mount has a fourth slope along a line tangent to the fourth inner surface, wherein the first slope is a greater absolute slope than the second, third, and fourth slopes, wherein the second slope is a greater absolute slope than the third and fourth slopes, and wherein the fourth slope is a greater absolute slope than the third slope.

6. The drink cup lid of claim 5, wherein a portion between the second seal ring and the third seal ring that is spaced apart from the rolled brim when the second annular liquid flow barrier and the third annular liquid flow barrier are established is substantially planar and is attached to the third seal ring.

7. The drink cup lid of claim 6, wherein the portion between the second seal ring and the third seal ring that is spaced apart from the rolled brim when the second-annular liquid flow barrier and the third annular liquid flow barrier are established is coupled to the second seal ring via a second substantially planar portion formed at an angle relative to the second seal ring and the portion attached to the third seal ring.

8. A drink cup lid comprising a central closure and a brim mount coupled to the central closure, the brim mount adapted to attach to a rolled brim of a cup having in series, first, second and third convex outer surfaces with a common center of curvature that define an outer boundary surface of the rolled brim characterized by a round shape and to form a plurality of annular liquid flow barriers including a first annular liquid flow barrier, a third annular liquid flow barrier, and a fourth annular liquid flow barrier, wherein the brim mount forms a perimeter surrounding the central closure, the brim mount having an annular inner portion adjacent the central closure and an oppositely disposed annular outer portion, the annular inner portion of the brim mount including a first seal ring having a first sloped inner surface sized and shaped to establish the first annular liquid flow barrier between the lid and the cup, a second seal ring with a second sloped inner surface which is adapted to engage the first convex outer surface of the rolled brim of the cup to establish a second annular liquid flow barrier between the lid and the cup, the annular outer portion of the brim mount including a third seal ring having a third sloped inner surface sized and shaped to establish the third annular liquid flow barrier between the lid and the second convex outer surface of the rolled brim of the cup, and the annular outer portion of the brim mount including a fourth seal ring having a fourth sloped inner surface sized and shaped to establish the fourth annular liquid flow barrier between the lid and the third convex outer surface of the rolled brim of the cup, wherein the first seal ring, the second seal ring, and the third seal ring have frustoconical shapes, wherein the first sloped inner surface of the brim mount has a first slope, the second sloped inner surface of the brim mount has a second slope, the third sloped inner surface of the brim mount has a third slope, and the fourth sloped inner surface of the brim mount has a fourth slope along a line tangent to the fourth inner surface, wherein the first slope is a greater absolute slope than the second, third, and fourth slopes, wherein the second slope is a greater absolute slope than the third and fourth slopes, and wherein the fourth slope is a greater absolute slope than the third slope.

9. The drink cup lid of claim 8, wherein the brim mount top is substantially planar and is coupled to the third seal ring.

10. The drink cup lid of claim 9, wherein the brim mount top is coupled to the first seal ring.

11. The drink cup lid of claim 8, wherein the brim mount is arranged with the first seal ring proximate the central closure, the brim mount top interposed between the first seal ring and fourth seal ring, and the third seal ring interposed between the brim mount top and the fourth seal ring.

12. The drink cup lid of claim 11, wherein when the drink cup lid is situated with the brim mount top above the first seal ring, the first seal ring extends outwardly away from the central closure, the third seal ring extends outwardly and downwardly away from the brim mount top, and the fourth seal ring extends inwardly and downwardly away from the third seal ring.

13. The drink cup lid of claim 8, wherein the central closure includes a liquid discharge outlet that is elevated relative to the brim mount.

* * * * *